US008652593B2

(12) United States Patent
Koenig

(10) Patent No.: US 8,652,593 B2
(45) Date of Patent: Feb. 18, 2014

(54) PRINTABLE SUBSTRATES WITH IMPROVED BRIGHTNESS FROM OBAS IN PRESENCE OF MULTIVALENT METAL SALTS

(75) Inventor: Michael F. Koenig, Loveland, OH (US)

(73) Assignee: International Paper Company, Memphis, TN (US)

( * ) Notice: Subject to any disclaimer, the term of this patent is extended or adjusted under 35 U.S.C. 154(b) by 279 days.

(21) Appl. No.: 12/640,637

(22) Filed: Dec. 17, 2009

(65) Prior Publication Data

US 2011/0151149 A1 Jun. 23, 2011

(51) Int. Cl.

| | |
|---|---|
| ***B41M 5/00*** | (2006.01) |
| ***B41M 5/50*** | (2006.01) |
| ***B41M 5/52*** | (2006.01) |

(52) U.S. Cl.

CPC ..... *B41M 5/508* (2013.01); *B41M 5/52* (2013.01); *B41M 5/5218* (2013.01); *B41M 5/506* (2013.01); *B41M 5/5254* (2013.01)

USPC ..... 428/32.18; 428/32.21; 428/32.3

(58) Field of Classification Search

CPC ..... B41M 5/508; B41M 5/52; B41M 5/5218; B41M 5/506; B41M 5/5254

USPC ..... 428/32.18, 32.21, 32.3

See application file for complete search history.

(56) References Cited

U.S. PATENT DOCUMENTS

| | | | |
|---|---|---|---|
| 3,293,114 | A | 12/1966 | Kenaga et al. |
| 3,533,908 | A | 10/1970 | Hoogsteen |
| 3,556,934 | A | 1/1971 | Meyer |
| 3,600,385 | A | 8/1971 | Loffelman |
| 3,719,514 | A | 3/1973 | Taylor |
| 3,956,283 | A | 5/1976 | Fleck |
| 4,040,900 | A | 8/1977 | Mazzarella et al. |
| 4,133,688 | A | 1/1979 | Sack |

(Continued)

FOREIGN PATENT DOCUMENTS

| | | |
|---|---|---|
| EP | 0629741 | 12/1994 |
| EP | 0652324 | 5/1995 |

(Continued)

OTHER PUBLICATIONS

Handbook of Pulp and Paper Terminology, Gary A. Smook, 2nd edition, pp. 283-285.

(Continued)

*Primary Examiner* — Betelhem Shewareged

(74) *Attorney, Agent, or Firm* — Thomas W. Barnes, III

(57) ABSTRACT

An article in the form of a paper substrate having a first surface and a second surface; an internal paper sizing agent present in an amount sufficient to impart to the paper substrate an HST value of from about 50 to about 250 seconds; one or more optical brightening agents present in an amount below a "green over" effect excess but sufficient to impart an ISO Brightness value of at least about 92; and a metal salt drying agent mixture of multivalent and monovalent metal drying salts in a molar ratio of multivalent to monovalent cations of from about 3:1 to about 1:18 to provide a percent ink transferred ("IT %") value equal to or less than about 65% and a black print density value of at least about 1.45. Also, a method for treating the optically brightened paper substrate with a mixture of multivalent and monovalent metal drying salts.

28 Claims, 5 Drawing Sheets

(56) References Cited

U.S. PATENT DOCUMENTS

| | | | |
|---|---|---|---|
| 4,251,824 | A | 2/1981 | Hara et al. |
| 4,279,794 | A | 7/1981 | Dumas |
| 4,381,185 | A | 4/1983 | Swanson et al. |
| 4,410,899 | A | 10/1983 | Haruta et al. |
| 4,412,224 | A | 10/1983 | Sugitani |
| 4,425,405 | A | 1/1984 | Murakami et al. |
| 4,446,174 | A | 5/1984 | Maekawa et al. |
| 4,478,910 | A | 10/1984 | Oshima et al. |
| 4,481,244 | A | 11/1984 | Haruta et al. |
| 4,483,889 | A | 11/1984 | Andersson |
| 4,496,629 | A | 1/1985 | Haruta et al. |
| 4,503,118 | A | 3/1985 | Murakami et al. |
| 4,517,244 | A | 5/1985 | Kobayashi et al. |
| 4,532,530 | A | 7/1985 | Hawkins |
| 4,554,181 | A | 11/1985 | Cousin et al. |
| 4,576,867 | A | 3/1986 | Miyamoto |
| 4,601,777 | A | 7/1986 | Hawkins et al. |
| 4,636,409 | A | 1/1987 | Arai et al. |
| 4,721,655 | A | 1/1988 | Trzasko |
| 4,740,420 | A | 4/1988 | Akutsu et al. |
| 4,792,487 | A | 12/1988 | Schubring et al. |
| 4,830,911 | A | 5/1989 | Kojima et al. |
| 4,877,680 | A | 10/1989 | Sakaki et al. |
| 4,908,240 | A | 3/1990 | Auhorn et al. |
| 5,013,603 | A | 5/1991 | Ogawa et al. |
| 5,125,996 | A | 6/1992 | Campbell et al. |
| 5,163,973 | A | 11/1992 | Ellis |
| 5,190,805 | A | 3/1993 | Atherton et al. |
| 5,270,103 | A | 12/1993 | Oliver et al. |
| 5,314,747 | A | 5/1994 | Malhotra et al. |
| 5,320,902 | A | 6/1994 | Malhotra et al. |
| 5,397,619 | A | 3/1995 | Kuroyama et al. |
| 5,405,678 | A | 4/1995 | Bilodeau |
| 5,429,860 | A | 7/1995 | Held et al. |
| 5,457,486 | A | 10/1995 | Malhotra et al. |
| 5,474,843 | A | 12/1995 | Lambert et al. |
| 5,514,429 | A | 5/1996 | Kamihgaraguchi et al. |
| 5,522,968 | A | 6/1996 | Kuroyama et al. |
| 5,537,137 | A | 7/1996 | Held et al. |
| 5,657,064 | A | 8/1997 | Malhotra |
| 5,729,266 | A | 3/1998 | Malhotra |
| 5,760,809 | A | 6/1998 | Malhotra et al. |
| 6,022,104 | A | 2/2000 | Lin et al. |
| 6,077,642 | A | 6/2000 | Ogata et al. |
| 6,123,760 | A | 9/2000 | Varnell |
| 6,162,328 | A | 12/2000 | Cennisio et al. |
| 6,207,258 | B1 | 3/2001 | Varnell |
| 6,350,507 | B1 | 2/2002 | Iwamoto et al. |
| 6,383,612 | B1 | 5/2002 | Waller |
| 6,414,055 | B1 | 7/2002 | Lauzon |
| 6,485,139 | B1 | 11/2002 | Lavery et al. |
| 6,528,119 | B1 | 3/2003 | MacMillan |
| 6,686,054 | B2 | 2/2004 | Nigam |
| 6,761,977 | B2 | 7/2004 | Nigam |
| 6,764,726 | B1 | 7/2004 | Yang et al. |
| 6,777,040 | B2 | 8/2004 | Tatsuhashi et al. |
| 6,786,586 | B2 | 9/2004 | Koga et al. |
| 6,880,928 | B2 | 4/2005 | Hosoi et al. |
| 6,977,100 | B2 | 12/2005 | Kondo et al. |
| 7,070,727 | B2 | 7/2006 | Calhoun et al. |
| 7,172,651 | B2 | 2/2007 | Chen et al. |
| 7,381,300 | B2 | 6/2008 | Skaggs et al. |
| 7,510,750 | B2 | 3/2009 | Koga et al. |
| 7,553,395 | B2 | 6/2009 | Stoffel et al. |
| 7,582,188 | B2 | 9/2009 | Stoffel et al. |
| 8,012,551 | B2 | 9/2011 | Song et al. |
| 2003/0227531 | A1 | 12/2003 | Hosoi |
| 2005/0124755 | A1 | 6/2005 | Mitchell |
| 2005/0217815 | A1 | 10/2005 | Stoffel et al. |
| 2006/0051528 | A1 | 3/2006 | Ogino |
| 2006/0060317 | A1 | 3/2006 | Roding et al. |
| 2006/0185808 | A1* | 8/2006 | Nguyen ..... 162/162 |
| 2006/0254738 | A1 | 11/2006 | Anderson |
| 2007/0087134 | A1 | 4/2007 | Tyan et al. |
| 2007/0087136 | A1 | 4/2007 | Stoffel et al. |
| 2007/0087138 | A1 | 4/2007 | Koenig et al. |
| 2007/0113995 | A1 | 5/2007 | Park |
| 2007/0113998 | A1 | 5/2007 | Park |
| 2007/0125267 | A1 | 6/2007 | Song et al. |
| 2007/0165977 | A1 | 7/2007 | Cole et al. |
| 2008/0081203 | A1 | 4/2008 | Knight et al. |
| 2008/0098931 | A1 | 5/2008 | Skaggs et al. |
| 2008/0173420 | A1 | 7/2008 | Song et al. |
| 2009/0035478 | A1 | 2/2009 | Zhou et al. |
| 2009/0110910 | A1 | 4/2009 | Kaimoto et al. |
| 2009/0165977 | A1 | 7/2009 | Huang et al. |
| 2009/0274855 | A1* | 11/2009 | Koenig et al. ..... 428/32.21 |
| 2009/0295892 | A1 | 12/2009 | Akiyama |
| 2009/0320708 | A1 | 12/2009 | Jackson et al. |
| 2010/0129553 | A1 | 5/2010 | Jackson et al. |
| 2011/0151148 | A1 | 6/2011 | Koenig et al. |
| 2011/0151149 | A1 | 6/2011 | Koenig |
| 2011/0205287 | A1 | 8/2011 | Zhou et al. |
| 2011/0240241 | A1 | 10/2011 | Koenig et al. |
| 2011/0240242 | A1 | 10/2011 | Koenig et al. |
| 2011/0274856 | A1 | 11/2011 | Koenig |
| 2012/0019587 | A1 | 1/2012 | Koenig |
| 2012/0121872 | A1 | 5/2012 | Koenig |

FOREIGN PATENT DOCUMENTS

| | | |
|---|---|---|
| EP | 0666368 | 8/1995 |
| EP | 0747235 | 12/1996 |
| EP | 1036666 | 9/2000 |
| EP | 1079356 | 2/2001 |
| EP | 1122085 | 8/2001 |
| EP | 0999937 B1 | 3/2002 |
| EP | 1355004 | 10/2003 |
| EP | 1566281 | 8/2005 |
| EP | 1571149 | 9/2005 |
| EP | 1582370 | 10/2005 |
| EP | 1712677 | 10/2006 |
| EP | 1743976 | 1/2007 |
| EP | 1775141 | 4/2007 |
| EP | 1947240 | 7/2008 |
| GB | 786543 | 11/1957 |
| GB | 903416 | 8/1962 |
| GB | 1373788 | 11/1974 |
| GB | 1533434 | 11/1978 |
| GB | 2307487 | 11/1995 |
| JP | 2002274012 | 9/2002 |
| JP | 2004255593 | 6/2004 |
| JP | 2006168017 | 6/2006 |
| WO | 9609345 | 3/1996 |
| WO | 9906219 | 2/1999 |
| WO | 9916973 | 4/1999 |
| WO | 03044275 | 5/2003 |
| WO | 2005115763 | 12/2005 |
| WO | 2006049545 | 5/2006 |
| WO | 2006110751 | 10/2006 |
| WO | 2007053681 | 5/2007 |
| WO | 2007141271 | 12/2007 |
| WO | 2008055858 | 5/2008 |
| WO | 2009110910 | 9/2009 |
| WO | 2009124075 | 10/2009 |
| WO | 2009146416 | 12/2009 |

OTHER PUBLICATIONS

Handbook of Pulp and Paper Terminology, Gary A. Smook, 2nd edition, pp. 289-292.

BeMiller et al., Starch, Ullmann's Encyclopedia of Industrial Chemistry, vol. 34, pp. 113-117. online John Wiley and Sons, Inc. 2011 Retrieved on May 16, 2012, Retrieved from Internet: http,onlinelibrary.wiley.com,doi,10.1002,14356007.a25_001. pub4,full.

Quantitative Determination of Alkyl Ketene dimer AKD retention in Paper made on a Pilot Paper Machine, pp. 253-260, 2002.

Automataic Color recognition System for Stockigt Sizing Test II, Journal of Korea TAPPI, 37, 1, 73-81, 2005.

C. E. Farley; R. B. Wasser. The Sizing of Paper. TAPPI Press, 1989, 51-62.

(56) References Cited

OTHER PUBLICATIONS

Paper and board—Determination of sizing—Stoeckigt method, JIS p. 8122: 2004, rev. Mar. 20, 2004, published by Japanese Standards Association.

Use of T530 HST on calcium carbonate-containing papers, Stever R. Boone, 1996, Tappi Journal, pp. 122-124.

Tracing Tecnique in Geohydrology by Werner Kass and Horst Behrens, published by Taylor Francis, 1998, pp. 48-55.

Sythetic Detergents in the Soap Industry Lime Soap Dispersion Test, H.C. Borghetty et al., J. Am. Oil, Chem. Soc., 27, 88-90 1950.

Lipids in Cereal Staraches: A Review; William R. Morrison; Jounal of Cereal Science 8 1988, pp. 1-15.

High Solids Modified Calcium Carbonates A Concept for Inkjet Papers, Varney Kukkamo, May 2010.

Handbook of Pulp and Paper Terminology, Gary A. Smook, 2nd edition, pp. 283-285—2000.

Handbook of Pulp and Paper Terminology, Gary A. Smook, 2nd edition, pp. 289-292—2000.

Chemistry and Application of Rosin Size, E. Strazdins, pp. 1-31—1989 TAPPI Press.

Pigment Coating Techniques, Chapter 24, pp. 415-417, Jukka Linnonmaa and Michael Trefz—2000.

* cited by examiner

PRINTABLE SUBSTRATES WITH IMPROVED BRIGHTNESS FROM OBAS IN PRESENCE OF MULTIVALENT METAL SALTS

FIELD OF THE INVENTION

The present invention broadly relates to printable substrates comprising paper substrates having improved brightness imparted by optical brightening agents (OBAs) in the presence of multivalent metal drying salts present on one or both surfaces of the paper substrate by partially replacing the multivalent metal drying salts with monovalent metal drying salts. The present invention further broadly relates a method for treating the optically brightened paper substrate with a mixture of multivalent and monovalent metal drying salts.

BACKGROUND

The brightness and whiteness of printable paper may be improved, for example, by treating the surface of the paper substrate with optical brightening agents (OBAs). OBAs are fluorescent materials which increase the brightness (e.g., white appearance) of paper substrate surfaces by absorbing the invisible portion of the light spectrum (e.g., from about 340 to about 370 nm) and converting this energy into the longer-wavelength visible portion of the light spectrum (e.g., from about 420 to about 470 nm). In other words, the OBAs convert invisible ultraviolet light and re-emits that converted light in the blue to blue-violet light region through fluorescence.

In improving the brightness or whiteness of paper substrates, OBAs often operate by compensating for a yellow tint or cast which may be present in paper substrates prepared from paper pulps which have, for example, been bleached to moderate levels. This yellow tint or cast is caused by the absorption of short-wavelength light (violet-to-blue) by the paper substrate. By treating the paper substrates with OBAs, this short-wavelength light causing the yellow tint or cast may be partially replaced, thus improving the brightness and whiteness of the paper substrate.

The use of OBAs in improving the brightness or whiteness of paper substrates is not without problems. These OBAs may interact or react with other chemicals used in papermaking. For example, many OBAs used in papermaking are anionic. Illustrative of these anionic OBAs are the stilbene-based sulfonates. By contrast, some of the chemicals used in papermaking are cationic, or have cationic moieties. These cationic chemicals used in papermaking may interact or react with these anionic OBAs such as the stilbene-based sulfonates. Such interactions or reactions may reduce the ability of these OBAs to optically brighten and whiten the paper substrate.

SUMMARY

According to a first broad aspect of the present invention, there is provided an article comprising a printable substrate, which comprises:

- a paper substrate having a first surface and a second surface;
- an internal paper sizing agent present in an amount sufficient to impart to the paper substrate an HST value of from about 50 to about 250 seconds;
- one or more optical brightening agents present in an amount below a "green over" effect excess but sufficient to impart to at least one of the first and second surfaces an ISO Brightness value of at least about 92; and

- a metal salt drying agent comprising a mixture of one or more multivalent metal drying salts and one or more monovalent metal drying salts and present on the at least one surface, wherein the metal salt drying agent is in an amount and has a molar ratio of multivalent cations to monovalent cations such that the at least one surface has a percent ink transferred ("IT %") value equal to or less than about 65% and a black print density value of at least about 1.45, and wherein the molar ratio of multivalent cations to monovalent cations is in the range from about 3:1 to about 1:18.

According to a second broad aspect of the present invention, there is provided a method comprising the following steps:

(a) providing a paper substrate having a first surface and a second surface, wherein an internal paper sizing agent is present in an amount sufficient to impart to the paper substrate an HST value of from about 50 to about 250 seconds; and (b) treating at least one of the first and second surfaces with a metal salt drying agent comprising a mixture of one or more multivalent metal drying salts and one or more monovalent metal drying salts, wherein the metal salt drying agent is in an amount and has a molar ratio of multivalent cations to monovalent cations such that the at least one surface has a percent ink transferred ("IT %") value equal to or less than about 65% and a black print density value of at least about 1.45, wherein the molar ratio of multivalent salts to monovalent salts is in the range from about 3:1 to about 1:18;

(c) wherein one or more optical brightening agents are present on the at least one of the first and second surfaces in an amount below a "green over" effect excess but sufficient to impart to the at least one of the first and second surfaces an ISO brightness value of at least about 92;

(d) wherein step (b) is carried out either by treating the at least one surface: (1) simultaneously with the multivalent salts and monovalent salts; or (2) sequentially first with the monovalent salts, followed by the multivalent salts.

BRIEF DESCRIPTION OF THE DRAWINGS

The invention will be described in conjunction with the accompanying drawings, in which.

DETAILED DESCRIPTION

Figure 1:
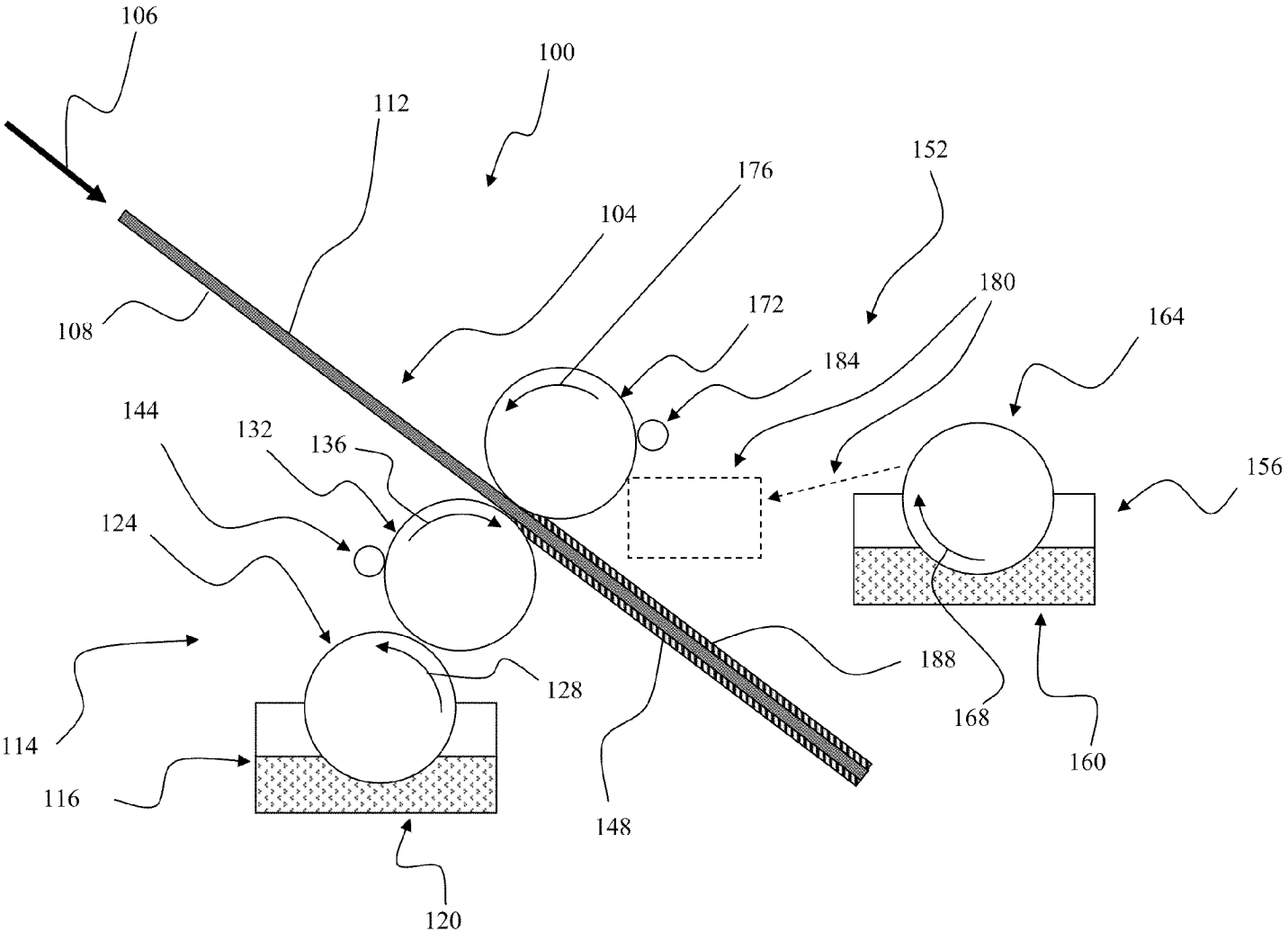
FIG. 1 a schematic diagram illustrating an embodiment of a method for treating one or both surfaces of a paper substrate with a coating composition comprising the metal salt drying agent using a metering rod size press.

It is advantageous to define several terms before describing the invention. It should be appreciated that the following definitions are used throughout this application.

Definitions

Where the definition of terms departs from the commonly used meaning of the term, applicant intends to utilize the definitions provided below, unless specifically indicated.

For the purposes of the present invention, directional terms such as "top", "bottom", "side," "front," "frontal," "forward," "rear," "rearward," "back," "trailing," "above", "below", "left", "right", "horizontal", "vertical", "upward", "downward", etc. are merely used for convenience in describing the various embodiments of the present invention. The embodiments of the present invention may be oriented in various ways.

For the purposes of the present invention, the term "printable substrate" refers to any paper substrate which may be printed on with an ink jet printing process. Printable substrates may include webs, sheets, strips, etc., may be in the form of a continuous roll, a discrete sheet, etc.

For the purposes of the present invention, the term "paper substrate" refers to a fibrous web that may be formed, created, produced, etc., from a mixture, furnish, etc., comprising paper fibers, internal paper sizing agents, etc., plus any other optional papermaking additives such as, for example, fillers, wet-strength agents, optical brightening agents (or fluorescent whitening agent), etc. The paper substrate may be in the form of a continuous roll, a discrete sheet, etc.

For the purposes of the present invention, the term "paper filler" refers commonly to mineral products (e.g., calcium carbonate, kaolin clay, etc.) which may be used in paper making to reduce materials cost per unit mass of the paper, increase opacity, increase smoothness, etc. These mineral products may be finely divided, for example, the size range of from about 0.5 to about 5 microns.

For the purposes of the present invention, the term "uncoated paper substrate" refers to a paper substrate which has 0 or substantially 0 paper surface loading of a coating composition present on one or both sides or surfaces of the paper substrate.

For the purposes of the present invention, the term "single-side coated paper substrate" refers to a paper substrate which has a surface loading of a coating composition present on one, but not both, sides or surfaces of the paper substrate.

For the purposes of the present invention, the term "double-side coated paper substrate" refers to a paper substrate which has a surface loading of a coating composition present on both sides or surfaces of the paper substrate.

For the purposes of the present invention, the term "calendered paper" refers to a paper substrate which has been subjected to calendering to, for example, smooth out the paper for enabling printing and writing on the paper, and to increase the gloss on the paper surface. For example, calendering may involve a process of using pressure for embossing a smooth surface on the still rough paper surface. Calendering of paper may be carried out on a calendar which may comprise a series of rolls at the end of a papermaking machine (on-line), or separate from the papermaking machine (off-line).

For the purposes of the present invention, the term "coating composition" refers to those compositions, which comprise, at minimum, a metal salt drying agent, and in some embodiments, one or more optical brightening agents (OBAs). These coating compositions may also include other optional additives, such as, for example, a calcium carbonate pigment component, plastic pigments, substrate pigment binders, surface paper sizing agents, cationic dye fixing agents, solvents, diluents, anti-scratch and mar resistance agents, etc. The coating composition may be formulated as an aqueous solution, an aqueous slurry, a colloidal suspension, a liquid mixture, a thixotropic mixture, etc.

For the purposes of the present invention, the term "solids basis" refers to the weight percentage of each of the respective solid materials (e.g., metal salt drying agent; optical brightener agent(s) (OBAs); calcium carbonate pigment component; a cationic dye fixing agent; plastic pigment, surface paper sizing agent, etc.) present in the coating composition, coating, etc., in the absence of any liquids (e.g., water). Unless otherwise specified, all percentages given herein for the solid materials are on a solids basis.

For the purposes of the present invention, the term "solids content" refers to the percentage of non-volatile, non-liquid components (by weight) that are present in the composition, etc.

For the purposes of the present invention, the term "substrate pigment" refers to a material (e.g., a finely divided particulate matter) which may be used or may be intended to be used to affect optical properties of a printable substrate.

For the purposes of the present invention, the term "calcium carbonate" refers various calcium carbonates which may be used as substrate pigments, such as precipitated calcium carbonate (PCC), ground calcium carbonate (GCC), modified PCC and/or GCC, etc.

For the purposes of the present invention, the term "precipitated calcium carbonate (PCC)" refers to a calcium carbonate which may be manufactured by a precipitation reaction and which may used as a substrate pigment. PCC may comprise almost entirely of the calcite crystal form of $CaCO_3$. The calcite crystal may have several different macroscopic shapes depending on the conditions of production. Precipitated calcium carbonates may be prepared by the carbonation, with carbon dioxide ($CO_2$) gas, of an aqueous slurry of calcium hydroxide ("milk of lime"). The starting material for obtaining PCC may comprise limestone, but may also be calcined (i.e., heated to drive off $CO_2$), thus producing burnt lime, CaO. Water may added to "slake" the lime, with the resulting "milk of lime," a suspension of $Ca(OH)_2$, being then exposed to bubbles of $CO_2$ gas. Cool temperatures during addition of the $CO_2$ tend to produce rhombohedral (blocky) PCC particles. Warmer temperatures during addition of the $CO_2$ tend to produce scalenohedral (rosette-shaped) PCC particles. In either case, the end the reaction occurs at an optimum pH where the milk of lime has been effectively converted to $CaCO_3$, and before the concentration of $CO_2$ becomes high enough to acidify the suspension and cause some of it to redissolve. In cases where the PCC is not continuously agitated or stored for many days, it may be necessary to add more than a trace of such anionic dispersants as polyphosphates. Wet PCC may have a weak cationic colloidal charge. By contrast, dried PCC may be similar to most ground $CaCO_3$ products in having a negative charge, depending on whether dispersants have been used. The calcium carbonate may be precipitated from an aqueous solution in three different crystal forms: the vaterite form which is thermodynamically unstable, the calcite form which is the most stable and the most abundant in nature, and the aragonite form which is metastable under normal ambient conditions of temperature and pressure, but which may convert to calcite at elevated temperatures. The aragonite form has an orthorhombic shape that crystallizes as long, thin needles that may be either aggregated or unaggregated. The calcite form may exist in several different shapes of which the most commonly found are the rhombohedral shape having crystals that may be either aggregated or unaggregated and the scalenohedral shape having crystals that are generally unaggregated.

For the purposes of the present invention, the term "low particulate surface area" with reference to the calcium carbonate pigment refers to a BET specific surface area of about 30 meters square per gram (hereinafter "msg") or less, for example, from about 5 to about 30 msg, more typically from about 8 to about 16 msg.

For the purposes of the present invention, the term "high particulate surface area" with reference to the calcium carbonate pigment refers to a BET specific surface area of greater than about 30 meters square per gram (hereinafter "msg"), for example, from about 30 to about 200 msg, more typically from about 50 to about 120 msg.

For the purposes of the present invention, the term "substrate pigment binder" refers to a binder agent for paper substrates which may be used to improve the substrate pigment binding strength of the coating composition, coating, etc. Substrate pigment binders may be hydrophilic. Suitable substrate pigment binders may include synthetic or naturally occurring polymers (or a combination of different polymers), for example, a polyvinyl alcohol (PVOH), starch binders, proteinaceous adhesives such as, for example, casein or soy proteins, etc.; polymer latexes such as styrene butadiene rubber latexes, acrylic polymer latexes, polyvinyl acetate latexes, styrene acrylic copolymer latexes, etc., or a combination thereof The substrate pigment binder may also be substantially free of starch binders and/or latexes as binders to improve the dry time of the coated printable substrate and to improve the processability of the printable substrate during the coating process.

For the purposes of the present invention, the term "substantially free" refers to a coating composition, coating, etc., having less than about 0.1% of a particular component by weight of the coating composition, coating, etc.

For the purposes of the present invention, the term "starch binder" refers to a binder agent for substrate pigments and/or paper substrates which comprises starch, a starch derivative, etc., or a combination thereof Suitable starch binders may be derived from a natural starch, e.g., natural starch obtained from a known plant source, for example, wheat, maize, potato, tapioca, etc. The starch binder may be modified (i.e., a modified starch) by one or more chemical treatments known in the paper starch binder art, for example, by oxidation to convert some of —$CH._2OH$ groups to —COOH groups, etc. In some cases the starch binder may have a small proportion of acetyl groups. Alternatively, the starch binder may be chemically treated to render it cationic (i.e., a cationic starch) or amphoteric (i.e., an amphoteric starch), i.e., with both cationic and anionic charges. The starch binder may also be a starch converted to a starch ether, or a hydroxyalkylated starch by replacing some—OH groups with, for example, —$OCH_2CH_2OH$ groups, —OCH2$CH_3$ groups, —$OCH_2CH_2CH_2OH$ groups, etc. A further class of chemically treated starch binders which may be used are known as the starch phosphates. Alternatively, raw starch may be hydrolyzed by means of a dilute acid, an enzyme, etc., to produce a starch binder in the form of a gum of the dextrin type.

For the purposes of the present invention, the term "metal salt drying agent" refers to those metal salts which may improve the dry time of inks deposited or printed on printable substrates by ink jet printing processes. These metal salt drying agents comprise a mixture of one or more multivalent metal drying salts and one or more monovalent metal drying salts. The counter anions for these metal salts may include, for example, chloride, bromide, acetate, bicarbonate, sulfate, sulfite, nitrate, hydroxide, silicate, chlorohydrate, etc.

For the purposes of the present invention, the term "multivalent metal drying salt" refers to those metal drying salts wherein the cationic moiety has a positive charge of two or more (e.g., a calcium cation, a magnesium cation, an aluminum cation, etc.) such as calcium salts, magnesium salts, aluminum salts, etc., and which are water soluble. Suitable multivalent metal drying salts (e.g., divalent salts, trivalent salts, etc.) may include one or more of calcium chloride, calcium acetate, calcium hydroxide, calcium nitrate, calcium sulfate, calcium sulfite, magnesium chloride, magnesium acetate, magnesium nitrate, magnesium sulfate, magnesium sulfite, aluminum chloride, aluminum nitrate, aluminum sulfate, aluminum chlorohydrate, sodium aluminum sulfate, vanadium chloride, etc.

For the purposes of the present invention, the term "monovalent metal drying salt" refers to those metal drying salts wherein the cationic moiety has a positive charge of one more (e.g., a sodium cation, a potassium cation, a lithium cation, etc.) such as sodium salts, potassium salts, lithium salts, etc. Suitable monovalent metal drying salts may include one or more of sodium chloride, sodium acetate, sodium carbonate, sodium bicarbonate, sodium hydroxide, sodium silicates, sodium sulfate, sodium sulfite, sodium nitrate, sodium bromide, potassium chloride, potassium acetate, potassium carbonate, potassium bicarbonate, potassium hydroxide, potassium silicates, potassium sulfate, potassium sulfite, potassium nitrate, potassium bromide, lithium chloride, lithium acetate, lithium carbonate, lithium bicarbonate, lithium hydroxide, lithium silicates, lithium sulfate, lithium sulfite, lithium nitrate, lithium bromide, etc.

For the purposes of the present invention, the term "cationic dye fixing agent" refers to those cationic compounds (e.g., nitrogen-containing compounds) or mixtures of such compounds which may aid in fixing, trapping, etc., inks printed by inkjet printing processes, and which may provide other properties, including water fastness. These cationic dye fixing agents may include compounds, oligomers and polymers which contain one or more quaternary ammonium functional groups, and may include cationic water-soluble polymers that are capable of forming a complex with anionic dyes. Such functional groups may vary widely and may include substituted and unsubstituted amines, imines, amides, urethanes, quaternary ammonium groups, dicyandiamides, guanadines, biguanides, etc. Illustrative of such compounds are polyamines, polyethyleneimines, polymers or copolymers of diallyldimethyl ammonium chloride (DADMAC), copolymers of vinyl pyrrolidone (VP) with quaternized diethylaminoethylmethacrylate (DEAMEMA), polyamides, polyhexamethylene biguanide (PHMB), cationic polyurethane latexes, cationic polyvinyl alcohols, polyalkylamines dicyandiamid copolymers, amine glycidyl addition polymers, poly [oxyethylene (dimethyliminio) ethylene (dimethyliminio)

ethylene]dichlorides, etc., or combinations thereof These cationic dye fixing agents may include low to medium molecular weight cationic polymers and oligomers having a molecular equal to or less than 100,000, for example, equal to or less than about 50,000, e.g., from about 10,000 to about 50,000. Illustrative of such materials are polyalkylamine dicyandiamide copolymers, poly[oxyethylene(dimethyliminio ethylene(dimethyliminioethylene]dichlorides and polyamines having molecular weights within the desired range. Cationic dye fixing agents suitable herein may include low molecular weight cationic polymers such as polyalkylamine dicyandiamid copolymer, poly[oxyethylene (dimethyliminio)ethylene (dimethyliminio)ethylene]dichloride, for example, low molecular weight polyalkylamine dicyandiamid copolymers. See U.S. Pat. No. 6,764,726 (Yang et al.), issued Jul. 20, 2004, the entire disclosure and contents of which is hereby incorporated by reference.

For the purposes of the present invention, the term "opacity" refers to the ability of a paper to hide things such as print images on subsequent sheets or printed on the back, e.g., to minimize, prevent, etc., show-through, etc. As used herein, opacity of the paper substrate may be measured by, for example, in terms of TAPPI opacity and show-through. TAPPI opacity may be measured by T425 om-91.

For the purposes of the present invention, the term "paper smoothness" refers to the extent to which the paper surface deviates from a planar or substantially planar surface, as affected by the depth of the paper, paper width, numbers of departure from that planar surface, etc. As used herein, the paper smoothness of a paper substrate may be measured by, for example, in terms of Parker Print Smoothness. Parker Print Smoothness may be measured by TAPPI test method T 555 om-99.

For the purposes of the present invention, the term "print quality" refers to those factors, features, characteristics, etc., that may influence, affect, control, etc., the appearance, look, form, etc., of a printed image on the printable substrate. Print quality of a paper substrate may be measured in terms of, for example, one or more of: (1) print density; (2) print contrast; (3) dry times); (4) edge acuity; (5) color gamut; (6) color richness; (7) print gloss; (8) print mottle; and (9) color-to-color bleed. For the purposes of the present invention, print quality of the paper substrate is primarily determined herein by measuring the print density, dry time, and edge acuity of the paper substrate.

For the purposes of the present invention, the term "print density" refers to the optical density ("OD") measured by using a reflectance densitometer (X-Rite, Macbeth. Etc.) which measures the light absorbing property of an image printed on a paper sheet. For example, the higher the print density, the darker the print image may appear. Higher print densities also provide a higher contrast, a sharper image for viewing, etc. Print density is measured herein in terms of the black print density (i.e., the print density of images which are black in color). The method for measuring black print density involves printing a solid block of black color on a paper sheet, and then measuring the optical density. The printer used to print the solid block of black color on the paper sheet is an HP Deskjet 6122, manufactured by Hewlett-Packard, (or its equivalent) which uses a #45 (HP product number 51645A) black ink jet cartridge (or its equivalent). The default setting of Plain Paper type and Fast Normal print quality print mode is used in printing the solid block of black color on the paper sheet. An X-Rite model 528 spectrodensitometer with a 6 mm aperture may be used to measure the optical density of the solid block of black color printed on the paper sheet to provide black print density values. The black print density measurement settings used are Visual color, status T, and absolute density mode. In general, acceptable black print density ("$OD_O$") values for black pigment are at least about 1.45 when using a standard (plain paper, normal) print mode for the HP desktop ink jet printer and when using the most common black pigment ink (equivalent to the #45 ink jet cartridge). Some embodiments of the paper substrates of the present invention may exhibit black print density ($OD_O$) values of at least about 1.50, for example, at least about 1.60. See also commonly assigned U.S. Pat. Appln. No. 2007/0087134 (Koenig et al.), published Apr. 19, 2007, the entire disclosure and contents of which is herein incorporated by reference, which describes how to carry out this black print density test.

For the purposes of the present invention, the term "print contrast" refers to the difference in print density between printed and unprinted areas.

For the purposes of the present invention, the term "dry time" refers to the time it takes for deposited ink to dry on the surface of a printable substrate. If the deposited ink does not dry quickly enough, this deposited ink may transfer to other printable substrate sheets, which is undesirable. The percentage of ink transferred ("IT %") is recorded as a measure of the dry time. The higher the amount of the percentage of ink transferred, the slower (worse) the dry time. Conversely, the lower the amount of the percentage of ink transferred, faster (better) the dry time. In general, embodiments of the paper substrates of the present invention provide a percent ink transferred ("IT %") value equal to or less than about 65%. In some embodiments of the paper substrates of the present invention, the IT % value may be equal to or less than about 50%, for example, equal to or less than about 40% (e.g., equal to or less than about 30%.

For the purposes of the present invention, the term "ink transfer" refers to a test for determining the dry time of a printable substrate, for example, printable paper sheets. "Ink transfer" is defined herein as the amount of optical density transferred after rolling with a roller, and is expressed as a percentage of the optical density transferred to the unprinted portion of the printable substrate (e.g., paper sheet) after rolling with a roller. The method involves printing solid colored blocks on paper having a basis weight of 20 lbs/1300 ft.$^2$, waiting for a fixed amount of time, 5 seconds after printing, and then folding in half so that the printed portion contacts an unprinted portion of the paper sheet, and rolling with a 4.5 lb hand roller as for example roller item number HR-100 from Chem Instruments, Inc., Mentor, Ohio, USA. The optical density is read on the transferred ($OD_T$), the non-transferred ($OD_O$) portions of the block, and an un-imaged area ($OD_B$) by a reflectance densitometer (X-Rite, Macbeth. Etc.). The percent transferred ("IT %") is defined as IT %=$[(OD_T-OD_B)/(OD_O-OD_B)]\times100$. See also commonly assigned U.S. Pat. Appln. No. 2007/0087134 (Koenig et al.), published Apr. 19, 2007, the entire disclosure and contents of which is herein incorporated by reference, which describes how to carry out the ink transfer test.

For the purposes of the present invention, the term "edge acuity (EA)" refers to the degree of sharpness (or raggedness) of the edge of a printed image (e.g., a printed line). Edge acuity (EA) may be measured by an instrument such as the QEA Personal Image Analysis System (Quality Engineering Associates, Burlington, Mass.), the QEA ScannerlAS, or the ImageXpert KDY camera-based system. All of these instruments collect a magnified digital image of the sample and calculate an EA value by image analysis. The EA value (also known as "edge raggedness") is defined in ISO method 13660. This method involves printing a solid line 1.27 mm or more in length, and sampling at a resolution of at least 600 dpi. The instrument calculates the location of the edge based on the darkness of each pixel near the line edges. The edge threshold may be defined as the point of 60% transition from the substrate reflectance factor (light area, $R_{max}$) to the image reflectance factor (dark area, $R_{max}$) using the equation $R_{60}=R_{max}-60\%\ (R_{max}-R_{min})$. The edge raggedness may then be defined as the standard deviation of the residuals from a line fitted to the edge threshold of the line, calculated perpendicular to the fitted line. For embodiments of paper substrates of the present invention, the EA value may be less than about 15, for example, less than about 12, such as less than about 10 (e.g., less than about 8). See also commonly assigned U.S. Pat. Appln. No. 2007/0087134 (Koenig et al.), published Apr. 19, 2007, the entire disclosure and contents of which is herein incorporated by reference, which describes how to measure edge acuity (EA) values.

For the purposes of the present invention, the term "color gamut" refers to the total collection of possible colors in any color reproduction system and may be defined by a complete subset colors. A higher color gamut value indicates a more vivid color print quality. Color gamut may be obtained by measuring the CIE L*, a*, b* of a series of color blocks, including white (unprinted area), cyan, magenta, yellow, red, green, blue and black, and from these measured values, calculating a suitable color gamut. The CIE L* represents the whiteness. The value of L* may range from zero (representing black) to 100 (representing white or a perfectly reflecting diffuser). The value of a* represents the degree of green/red. A positive a* is red, while a negative a* is green. A positive b* is yellow, while a negative b* is blue. The CIE L*, a* and b* values may be measured by X-Rite 528 using a D65 light source and a 10-degree viewing angle.

For the purposes of the present invention, the term "color richness" refers to a more vivid or vibrant color print with high print density and high color gamut values.

For the purposes of the present invention, the term "gloss" refers to the ability of paper to reflect some portion of the incident light at the mirror angle. Gloss may be based on a measurement of the quantity of light specularly reflected from the surface of a paper specimen at a set angle, for example, at 75 degrees, such as in the case of 75 degree gloss (and as measured by TAPPI test method T 480 om-92).

For the purposes of the present invention, the term "print gloss" refers to a gloss measurement made on a printed paper substrate.

For the purposes of the present invention, the term "print mottle" refers to non-uniformity in the print image which may be due to unevenness in ink lay, non-uniform ink absorption, etc., across the printable substrate surface. Print mottle may be measured using a scanner based mottle tester such as the C3PATX03 Formation and Mottle Test with an Agfa Model DUOSCAN scanner. The printable substrate (e.g., paper sheet) sample to be tested is first printed on a test ink jet printer. The test pattern must include a block of solid black (100%) image. The color block is a square of about 20-50 mm by 20-50 mm. After 20 minutes of waiting time, or when the printed image is fully dried, the printed sample is positioned on the scanner with printed face down. The scanner is set at a resolution of 500 ppi (pixel per inch). A Verity software (Verity IA LLC, 2114 Sunrise Drive, Appleton, Wis. 54914) may be used to analyze the test data from the scanner. An appropriate dimension for testing based on the color block dimension is set. Two mottle indices may be measured: Micro Mottle Index and Macro Mottle Index. The Micro Mottle Index measures density variations within an area of 0.1 $in^2$; while the macro mottle index measures the density variations of the averaged density values of each square of 0.1 $in^2$. The lower the mottle index value, the better the print quality.

For the purposes of the present invention, the term "color-to-color bleed" refers to the spreading of one color ink into another color ink on paper which may reduce the resolution of the colored text and lines on a colored background. For example blue and black bars may be printed over a yellow color background. Green and black bars may be printed over magenta color background, and red and black bars may be printed over cyan color background. The smallest distance in microns between two color bars without bridging (or color intruding more than half way to the neighboring color bar) is recorded as the color-to-color bleed index. In other words, the smaller the value of color-to-color bleed, the better the print quality. Distances which may be tested include 50 microns, 100 microns, 150 microns, 300 microns, etc. In some embodiments of the present invention, the tested distance may reach 150 microns or less before bridging (bleed) occurs, which may be considered a "good" color-to-color bleed property.

For the purposes of the present invention, the term "digital printing" refers to reproducing, forming, creating, providing, etc., digital images on a printable substrate, for example, paper, Digital printing may include laser printing, ink jet printing, etc.

For the purposes of the present invention, the term "laser printing" refers to a digital printing technology, method, device, etc., that may use a laser beam to create, form produce, etc., a latent image on, for example, photoconductor drum. The light of laser beam may later create charge on the drum which may then pick up toner which carries an opposite charge. This toner may then be transferred to the paper and the resulting print image created, formed, produced, etc., fused to the printable substrate through, for example, a fuser.

For the purposes of the present invention, the term "electrophotographic recording process" refers to a process which records images on a printable substrate, such as paper, by xerography or electrophotography. In an electrophotographic process, the image is often formed on of the c by toner particles which are deposited one surface or side of the printable substrate, and are then thermally fixed and/or fused to that one surface or side of the printable substrate, for example, by heating. In electrophotographic recording, the printable substrate may have two relatively smooth or flat sides or surfaces, or may have one side or surface which is textured, uneven or nonsmooth/nonflat, while the other side or surface is relatively smooth or flat.

For the purposes of the present invention, the term "ink jet printing" refers to a digital printing technology, method, device, etc., that may form images on a printable substrate, such as paper, by spraying, jetting, etc., tiny droplets of liquid inks onto the printable substrate through the printer nozzles. The size (e.g., smaller size), precise placement, etc., of the ink droplets may be provide higher quality inkjet prints. Ink jet printing may include continuous ink jet printing, drop-on-demand ink jet printing, etc.

For the purposes of the present invention, the term "liquid" refers to a non-gaseous fluid composition, compound, material, etc., which may be readily flowable at the temperature of use (e.g., room temperature) with little or no tendency to disperse and with a relatively high compressibility.

For the purposes of the present invention, the term "viscosity," with reference to coating compositions, refers to Brookfield viscosity. The Brookfield viscosity may be measured by a Brookfield viscometer at 150° F., using a #5 spindle at 100 rpm.

For the purpose of the present invention, the term "printer" refers to any device which prints an image on a printable substrate, such as a paper sheet, including laser printers, inkjet printers, electrophotographic recording devices (e.g., copiers), scanners, fax machines, etc.

For the purpose of the present invention, the term "printer pigment" may refer to either ink (as used by, for example, an inkjet printer, etc.) and toner (as used by, for example, a laser printer, electrographic recording device, etc.).

For the purpose of the present invention, the term "ink" refers printer pigment as used by ink jet printers. The term ink may include dye-based inks and/or pigment-based inks. Dye-based inks comprise a dye which may be an organic molecule which is soluble in the ink medium. Dye-based inks may be classified by their usage, such as acid dyes, basic dyes, or direct dyes, or by their chemical structure, such as azo dyes, which are based on the based on an —N═N— azo structure; diazonium dyes, based on diazonium salts; quinone-imine dyes, which are derivates of quinine, etc. Pigment-based dyes comprise a pigment, which is a solid colored particle suspended in the ink medium. The particle may comprise a colored mineral, a precipitated dye, a precipitated dye which is attached to a carrier particle, etc. Inks are often dispensed, deposited, sprayed, etc., on a printable medium in the form of droplets which then dry on the printable medium to form the print image(s).

For the purpose of the present invention, the term "toner" refers printer pigment as used by laser printers. Toner is often dispensed, deposited, etc., on the printable medium in the form of particles, with the particles then being fused on the printable medium to form the image.

For the purposes of the present invention, the term "coater" refers to a device, equipment, machine, etc., which may be used to treat, apply, coat, etc., coating compositions to one or more sides or surfaces of a paper substrate, for example, just after the paper substrate has been dried for the first time. Coaters may include air-knife coaters, rod coaters, blade coaters, size presses, etc. See G. A. Smook, Handbook for Pulp and Paper Technologists ($2^{nd}$ Edition, 1992), pages 289-92, the entire contents and disclosure of which is herein incorporated by reference, for a general description of coaters that may be useful herein. Size presses may include a puddle size press, a metering size press, etc. See G. A. Smook, Handbook for Pulp and Paper Technologists ($2^{nd}$ Edition, 1992), pages 283-85, the entire contents and disclosure of which is herein incorporated by reference, for a general description of size presses that may be useful herein.

For the purposes of the present invention, the term "flooded nip size press" refers to a size press having a flooded nip (pond), also referred to as a "puddle size press." Flooded nip size presses may include vertical size presses, horizontal size presses, etc.

For the purposes of the present invention, the term "metering size press" refers to a size press that includes a component for spreading, metering, etc., deposited, applied, etc., coating composition or coating on a paper substrate side or surface. Metering size presses may include a rod metering size press, a gated roll metering size press, a doctor blade metering size press, etc.

For the purposes of the present invention, the term "rod metering size press" refers to metering size press that uses a rod to spread, meter, etc., the coating composition or coating on the paper substrate surface. The rod may be stationary or movable relative to the paper substrate.

For the purposes of the present invention, the term "gated roll metering size press" refers to a metering size press that may use a gated roll, transfer roll, soft applicator roll, etc. The gated roll, transfer roll, soft applicator roll, etc., may be stationery relative to the paper substrate, may rotate relative to the paper substrate, etc.

For the purposes of the present invention, the term "doctor blade metering size press" refers to a metering press which may use a doctor blade to spread, meter, etc., the coating composition or coating on the paper substrate surface.

For the purposes of the present invention, the term "room temperature" refers to the commonly accepted meaning of room temperature, i.e., an ambient temperature of 20° to 25° C.

For the purposes of the present invention, the term "paper substrate surface coverage" refers to amount of a coating present on a given side or surface of the paper substrate being treated. Paper substrate surface coverage may be defined in terms of grams of composition per square meter of paper substrate (hereinafter referred to as "gsm").

For the purposes of the present invention, the term "remains predominantly on the surface(s) of the paper substrate" refers to the coating composition or coating remaining primarily on the surface of the paper substrate, and not being absorbed by or into the interior of the paper substrate.

For the purpose of the present invention, the term "treating" with reference to the metal salt drying agents, optical brightening agents (OBAs), coating compositions, etc., may include depositing, applying, spraying, coating, daubing, spreading, wiping, dabbing, dipping, etc.

For the purpose of the present invention, the term "Hercules Sizing Test" or "HST" refers to a test of resistance to penetration of, for example, an acidic water solution through paper. The HST may be measured using the procedure of TAPPI Standard Method 530 pm-89. See U.S. Pat. No. 6,764,726 (Yang et al.), issued Jul. 20, 2004, the entire disclosure and contents of which is hereby incorporated by reference. The HST value is measured following the conventions described in TAPPI Standard Method number T-530 pm-89, using 1% formic acid ink and 80% reflectance endpoint. The HST value measured reflects the relative level of paper sizing present in and/or on the paper substrate. For example, lower HST values (i.e., HST values below about 50 seconds) reflect a relatively low level of paper sizing present in the paper substrate. Conversely, higher HST values (i.e., HST values above about 250 seconds) reflect a relatively high level of paper sizing present in and/or on the paper substrate. For the purposes of the present invention, an HST value in the range from about 50 to about 250 seconds is considered to be an intermediate HST value reflecting an intermediate level of paper sizing present in and/or on the paper substrate. The HST value measured also reflects both the level of both internal paper sizing, as well as the level of surface paper sizing present. But at the relatively low levels of paper sizing agents normally used in papermaking (e.g., from about 1 to about 2 lbs/ton or from about 0.04 to about 0.08 gsm for paper having a basis weight of 20 lbs/1300 $ft.^2$), the HST value of the paper substrate primarily (if not exclusively) reflects the contribution imparted by the internal paper sizing agents (which generally increase HST values greatly even at low usage levels), rather than surface paper sizing agents (which generally increase HST values minimally at such low usage levels).

For the purposes of the present invention, the term "level of paper sizing" refers to the paper sizing level present in and/or on the paper substrate, and may comprise internal sizing, surface sizing, or both internal sizing and surface sizing.

For the purposes of the present invention, the term "internal sizing" refers to paper sizing present in the paper substrate due to internal paper sizing agents which are included, added, etc., during the papermaking process before a fibrous paper substrate is formed. Internal paper sizing agents generally resist penetration of water or other liquids into the paper substrate by reacting with the paper substrate to make the paper substrate more hydrophobic. Illustrative internal paper sizing agents may include, for example, alkyl ketene dimers, alkenyl succinic anhydrides, etc.

For the purposes of the present invention, the term "surface sizing" refers to paper sizing present in the paper substrate due to surface paper sizing agents which are applied on, added to, etc., the surface of the formed fibrous paper substrate. Surface paper sizing agents generally resist penetration of water or other liquids into the paper substrate by covering the paper substrate with a more hydrophobic film. Illustrative surface paper sizing agents may include, for example, starch, modified starch, styrene maleic anhydride copolymers, styrene acrylates, etc.

For the purposes of the present invention, the term "optical brightener agent (OBA)" refers to certain fluorescent materials which may increase the brightness (e.g., white appearance) of paper substrate surfaces by absorbing the invisible portion of the light spectrum (e.g., from about 340 to about 370 nm) and converting this energy into the longer-wavelength visible portion of the light spectrum (e.g., from about 420 to about 470 nm). In other words, the OBA converts invisible ultraviolet light and re-emits that converted light into blue to blue-violet light region through fluorescence. OBAs may also be referred to interchangeably as fluorescent whitening agents (FWAs) or fluorescent brightening agents (FBAs). The use of OBAs is often for the purpose of compensating for a yellow tint or cast of paper pulps which have, for example, been bleached to moderate levels. This yellow tint or cast is produced by the absorption of short-wavelength light (violet-to-blue) by the paper substrate. With the use of OBAs, this short-wavelength light that causes the yellow tint or cast is partially replaced, thus improving the brightness and whiteness of the paper substrate. OBAs are desirably optically colorless when present on the paper substrate surface, and do not absorb light in the visible part of the spectrum. These OBAs are anionic and may include one or more of 4,4'-bis-(triazinylamino)-stilbene-2,2'-disulfonic acids, 4,4'-bis-(triazol-2-yl)stilbene-2,2'-disulfonic acids, 4,4'-dibenzofuranyl-biphenyls, 4,4'-(diphenyl)-stilbenes, 4,4'-distyryl-biphenyls, 4-phenyl-4'-benzoxazolyl-stilbenes, stilbenzyl-naphthotriazoles, 4-styryl-stilbenes, bis-(benzoxazol-2-yl) derivatives, bis-(benzimidazol-2-yl) derivatives, coumarins, pyrazolines, naphthalimides, triazinyl-pyrenes, 2-styryl-benzoxazole or -naphthoxazoles, benzimidazole-benzofurans or oxanilides, etc, See commonly assigned U.S. Pat. No. 7,381,300 (Skaggs et al.), issued Jun. 3, 2008, the entire contents and disclosure of which is herein incorporated by reference. In particular, these OBAs may comprise, for example, one or more stilbene-based sulfonates (e.g., disulfonates, tetrasulfonates, or hexasulfonates) which may comprise one or two stilbene residues. Illustrative examples of such anionic stilbene-based sulfonates may include 1,3,5-triazinyl derivatives of 4,4'-diaminostillbene-2,2'-disulphonic acid (including salts thereof), and in particular the bistriazinyl derivatives (e.g., 4,4-bis(triazine-2-ylamino)stilbene-2,2'-disulphonic acid), the disodium salt of distyrlbiphenyl disulfonic acid, the disodium salt of 4,4'-di-triazinylamino-2,2'-di-sulfostilbene, etc. Commercially available disulfonate, tetrasulfonate and hexasulfonate stilbene-based OBAs may also be obtained, for example, from Ciba Geigy under the trademark TINOPAL®, from Clariant under the trademark LEUCOPHOR®, from Lanxess under the trademark BLANKOPHOR®, and from 3V under the trademark OPTIBLANC®.

For the purposes of the present invention, the term "brightness" refers to the diffuse reflectivity of paper, for example, at a mean wavelength of light of 457 nm. As used herein, brightness of the paper substrate may be measured in terms of ISO Brightness which measures brightness using, for example, an ELREPHO Datacolor 450 spectrophotometer, according to test method ISO 2470-1, using a C illuminant with UV included. For embodiments of paper substrates of the present invention, an ISO Brightness value of at least about 92 is considered an acceptable degree of brightness. In some embodiments of paper substrates of the present invention, the ISO Brightness value may be at least about 94, for example, at least about 96.

For the purposes of the present invention, the term "whiteness" refers to the white impression of paper, normally favoring a bluish cast or tint. As used herein, whiteness of the paper substrate may be measured in terms of CIE Whiteness which measures whiteness using, for example, an ELREPHO Datacolor 450 spectrophotometer, according to test method ISO 11475, using a D65 outdoor illuminant. For embodiments of paper substrates of the present invention, a CIE Whiteness value of at least about 135 is considered an acceptable degree of brightness. In some embodiments of paper substrates of the present invention, the CIE Whiteness value may be at least about 145, for example, at least about 155.

For the purposes of the present invention, the term "quenching" refers to the diminishing, decreasing, reducing, extinguishing, etc., of the fluorescence of OBAs by other cationic molecules, compounds, etc. Cationic molecules which may cause quenching of the fluorescence of OBAs include multivalent metal drying salts, such as calcium chloride.

Description

Embodiments of the articles of the present invention comprising printable substrates solve the problem of diminished, decreased, reduced, etc., paper brightening obtained with, for example, stilbene-based optical brightening agents (OBAs) when multivalent metal salts, such as calcium chloride, are added to, for example, a size press. The embodiments of these printable substrates comprise a paper substrate having an HST value of from about 50 to about 250 seconds (i.e., an intermediate HST value), one or more OBAs, and a metal salt drying agent comprising a mixture of one or more multivalent metal drying salts and one or more monovalent metal drying salts. Multivalent metal drying salts, such as calcium chloride, may be used as the metal salt drying agent to improve the ink dry time and print density of paper substrates. But, because OBAs have an anionic (negative) charge, these anionic molecules are electrostatically attracted to multivalent cationic (positively charged) molecules, such as the divalent calcium ion of calcium chloride.

This attraction of, and interaction between, anionic OBAs and multivalent cationic metal ions, such as divalent cationic metal ions (e.g., the calcium ions of calcium chloride), may interfere with the fluorescence of the OBAs. Such interference often occurs in such a way that the fluorescence of the OBAs may be partially or completely quenched, and thus the OBAs may lose their ability to impart an optical brightening effect to the paper substrate surface. As a result, the optical brightening of the OBA may be significantly diminished, decreased, etc., by the presence of multivalent metal drying salts, such as calcium chloride, including to the point that the OBAs may impart insufficient optical brightness to the paper substrate surface.

Previously, the quenching effect of these multivalent metal drying salts (e.g., calcium chloride) added during papermaking was compensated for by adding more OBA(s), for example, to the size press. In other words, this additional OBA(s) compensated for the reduced brightening activity of OBA caused by the multivalent metal drying salt, such as calcium chloride, interacting with the OBA. But increasing the amount of OBA(s) added may also cause an undesired a "green over" effect if an excess of OBA(s) is present. This "green over" effect is due to the "yellow" color of the excess OBA(s) optically blending with the blue/violet light reflected by the OBA(s) (in fluorescing) to thus impart a "greenish" tint, shade, hue, etc., to the paper substrate surface.

This decreasing, diminishing, etc., brightness problem of OBAs caused by the inclusion of multivalent metal drying salts, such as calcium chloride, may now be solved in embodiments of printable substrates of the present invention comprising these paper substrates by partially replacing these multivalent metal drying salts, such as calcium chloride, with monovalent metal drying salts, for example, sodium salts such as sodium chloride. By partially replacing the multivalent metal drying salts with monovalent metal drying salts, the optical brightness imparted by OBAs to the paper substrate surfaces may be increased without having to increase the amount of the OBA to thus risk causing a "green over" effect. Such partial replacement of multivalent metal drying salts with monovalent metal drying salts also permits satisfactory benefits to be imparted to the paper substrate in terms of ink dry times (measured in terms of percent ink transfer transferred or IT %), and especially good print density (measured in terms of black print density values) to be obtained with, for example, pigmented inks used in ink jet printing, as well as good edge acuity (EA).

In some embodiments, when a multivalent metal drying salt, such as calcium chloride, is replaced with, for example, an equal amount (by weight) of a monovalent metal drying salt, such as sodium chloride, the optical brightness imparted by the OBA to the paper substrate surface increases but the print density of the paper substrate may also decrease. Accordingly, the amount of the monovalent metal drying salt (e.g., sodium chloride) which replaces the multivalent metal drying salt (e.g., calcium chloride) needs to be controlled to obtain the dual benefits of higher optical brightness, along with good print density, for embodiments of these paper substrates. For embodiments of the paper substrates of the present invention, the amount of multivalent metal drying salts (e.g., calcium chloride) to monovalent metal drying salts (e.g., sodium chloride) is such as to provide a molar ratio of multivalent cations (e.g., calcium) to monovalent cations (e.g., sodium) which may be in the range of from about 3:1 to about 1:18, for example, in the range of from about 1.5:1 to about 1:12 (e.g., from about 1:2 to about 1:6). For embodiments of the paper substrates of the present invention wherein the metal drying salt agent comprises, for example, a mixture of calcium chloride and sodium chloride, these molar ratio ranges of multivalent to monovalent cations correspond to weight ratios of calcium chloride to sodium chloride of from about 6:1 to about 1:9, from about 3:1 to about 1:6, and from about 1:1 to about 1:3, respectively.

In addition, when replacing multivalent metal drying salts (e.g., calcium chloride) with monovalent metal drying salts (e.g., sodium chloride), the paper substrate needs to have an intermediate internal sizing value (as measured by the Hercules Sizing Test) of from about 50 to about 250 seconds. If the Hercules Sizing Test (HST) value of the paper is below about 50 seconds (low paper sizing level), replacing multivalent metal drying salts (e.g., calcium chloride) with, for example, an equal amount of monovalent metal drying salts (e.g., sodium chloride), i.e., a 1:1 weight ratio, may greatly decrease the print density of the paper substrate compared to paper substrates which use only multivalent metal drying salts (e.g., calcium chloride), i.e., without monovalent metal drying salts (e.g., sodium chloride). At HST values above about 250 seconds (high paper sizing level), the ink dry time of the paper substrate may be too slow.

Embodiments of the paper substrate of the present invention may comprise an internal paper sizing agent in an amount sufficient to impart to the paper substrate an HST value of from about 50 to about 250 seconds, for example, an HST value of from about 60 to about 200 seconds, such as from about 70 to about 160 seconds. In embodiments of methods of the present invention, one or both surfaces of these internally sized paper substrates may be treated with the metal salt drying agent (e.g., treated with a coating composition containing the metal salt drying agent), wherein the metal salt drying agent comprises a mixture of one or more multivalent metal drying salts and one or more monovalent metal drying salts in amounts (and in weight ratios of multivalent metal drying salts to monovalent metal drying salts) sufficient to provide paper substrates with dry times as specified above in terms of percent ink transferred ("IT %") values (e.g., equal to or less than about 65%). Coverage of one or both surfaces of these internally sized paper substrates with the metal salt drying agent (e.g., in a coating composition) may be sufficient to provide coverage of the metal salt drying agent on each of the respective surfaces treated with, for example, from about 0.2 to about 2 gsm (e.g., from about 0.5 to about 1.2 gsm) of the metal salt drying agent.

In some embodiments of these methods, it has also been found that treating (e.g., coating) the paper substrate surface with the multivalent metal drying salts (e.g., calcium chloride) at the same time as the monovalent metal drying salts (e.g., sodium chloride), for example, as part of the same coating composition, may increase the optical brightness imparted by the OBAs to the paper substrate surface. Alternatively, in other embodiments of these methods, the multivalent metal drying salts (e.g., calcium chloride) and the monovalent metal drying salts (e.g., sodium chloride) may be added sequentially to the paper substrate, for example, by adding the monovalent metal drying salts (e.g., sodium chloride) first to the paper substrate, followed by adding the multivalent metal drying salts (e.g., calcium chloride) to the paper substrate treated with the monovalent metal drying salts, and vice versa.

In some embodiments, the paper substrate may be treated with the OBAs being included as part of the coating composition comprising the metal salt drying agent (e.g., a mixture of monovalent and multivalent metal drying salts, or with the monovalent metal drying salt when added sequentially). Alternatively, in other embodiments, the paper substrate may be treated with the OBAs separately from the coating composition comprising the metal salt drying agent. The OBA pickup on one or both paper substrate surfaces with the OBAs (separately or from coating compositions comprising the metal salt drying agent) is sufficient to impart an ISO Brightness value of at least about 92 (e.g., at least about 94), but below a "green over" effect excess. For example, a pickup of from about 0.5 to about 2 wt % of the OBAs (such as the stilbene-based sulfonates) per ton of paper substrate (e.g., from about 1 to about 2 wt % of the OBAs per ton of paper substrate) on each surface of the paper substrate is sufficient to impart an ISO Brightness value of at least about 92, but below a "green over" effect excess. In addition to imparting an coverage ISO Brightness value of at least about 92 (but below a "green over" effect excess), this coverage with the OBAs may also impart a CIE Whiteness value to the paper substrate surfaces of at least about 135 (e.g., at least about 145).

Embodiments of the coating compositions used in these methods may comprise the metal salt drying agent in an amount of, for example, from about 1 to about 40% by weight (e.g., from about 5 to about 25% by weight) of the composition (on a solids basis). In addition to the metal salt drying agent, embodiments of the coating composition used in these methods may also optionally comprise one or more of the following: one or more optical brightening agents (OBAs) in an amount of up to about 30% by weight (e.g., from about 0 to about 10% by weight) of the composition; a calcium carbonate pigment component in an amount of up to about 25% by weight (e.g., from about from about 10 to about 60% by weight) of the composition (on a solids basis); a surface paper sizing agent in amount of up to about 5% by weight (e.g., from about from about 0.5 to about 2% by weight) of the composition; a cationic dye fixing agent in an amount up to about 20% by weight (e.g., from about 5 to about 15% by weight) of the composition (on a solids basis); optionally a pigment binder in an amount of up to about 90% by weight (e.g., from about 5 to about 75% by weight) of the composition (on a solids basis); and a plastic pigment in an amount of up to about 30% by weight (e.g., from 0 to about 20% by weight) of the composition (on a solids basis); and (on a solids basis).

The coating composition may comprise from about 7 to about 25% solids (e.g., from about 8 to about 16% solids). The amount of solids applied from the coating composition to the paper substrate surfaces (also referred to as "dry pickup") may, for example, be in the range of from about 40 to about 240 lbs/ton for a paper substrate with basis weight of 20 lbs/1300 square feet (e.g., from about 50 to about 150 lbs/ton). These dry pickups are equivalent to amounts in the range of from about 1.5 to about 9 grams per square meter (gsm) for a paper substrate with basis weight of 20 lbs/1300 square feet (e.g., from about 2 to about 6 gsm).

An embodiment of a method of the present invention for treating one or both surfaces of the paper substrate with the coating composition comprising the metal salt drying agent (plus OBAs and any other optional ingredients) is further illustrated in FIG. 1. Referring to FIG. 1, an embodiment of a system for carrying out an embodiment of the method of the present invention is illustrated which may be in the form of, for example a rod metering size press indicated generally as 100. Size press 100 may be used to coat a paper substrate, indicated generally as 104. Substrate 104 moves in the direction indicated by arrow 106, and which has a pair of opposed sides or surfaces, indicated, respectively, as 108 and 112.

Size press 100 includes a first assembly, indicated generally as 114, for applying the coating composition to surface 108. Assembly 114 includes a first reservoir, indicated generally as 116, provided with a supply of a coating composition, indicated generally as 120. A first take up roll, indicated generally as 124 which may rotate in a counterclockwise direction, as indicated by curved arrow 128, picks up an amount of the coating composition from supply 120. This amount of coating composition that is picked up by rotating roll 124 may then be transferred to a first applicator roll, indicated generally as 132, which rotates in the opposite and clockwise direction, as indicated by curved arrow 136. (The positioning of first take up roll 124 shown in FIG. 1 is simply illustrative and roll 124 may be positioned in various ways relative to first applicator roll 132 such that the coating composition is transferred to the surface of applicator roll 132.) The amount of coating composition that is transferred to first applicator roll 132 may be controlled by metering rod 144 which spreads the transferred composition on the surface of applicator roll 132, thus providing relatively uniform and consistent thickness of a first coating, indicated as 148, when applied onto the first surface 108 of substrate 104 by applicator roll 232.

As shown in FIG. 1, size press 100 may also be provided with a second assembly indicated generally as 152, for applying the coating composition to surface 112. Assembly 152 includes a second reservoir indicated generally as 156, provided with a second supply of a coating composition, indicated generally as 160. A second take up roll, indicated generally as 164 which may rotate in a clockwise direction, as indicated by curved arrow 168, picks up an amount of the coating composition from supply 160. This amount of coating composition that is picked up by rotating roll 164 may then be transferred to second take up roll, indicated generally as 172, which rotates in the opposite and counterclockwise direction, as indicated by curved arrow 176. As indicated in FIG. 1 by the dashed-line box and arrow 176, second take up roll 164 may be positioned in various ways relative to second applicator roll 172 such that the coating composition is transferred to the surface of applicator roll 172. The amount of coating composition that is transferred to second applicator roll 172 may be controlled by a second metering rod 184 which spreads the transferred composition on the surface of applicator roll 172, thus providing relatively uniform and consistent thickness of the second coating, indicated as 188, when applied onto the second surface 112 of substrate 104 by applicator roll 172.

EXAMPLES

Several embodiments of coating compositions are prepared from the ingredients shown in Table 1 below:

TABLE 1

| Coating Composition | Component 1 | Component 2 | Component 3 |
|---|---|---|---|
| 1 | Water | None | None |
| 2 | Starch | Calcium Chloride[1] | None |
| 3 | Starch | Magnesium Chloride[1] | None |
| 4 | Starch | Magnesium Sulfate[1] | None |
| 5 | Starch | Sodium Sulfate[1] | None |
| 6 | Starch | Sodium Chloride | None |
| 7 | Starch | None | None |
| 8 | Starch | Calcium Chloride[2] | None |
| 9 | Starch | Calcium Chloride[3] | Calcium Acetate[4] |
| 10 | Starch | Calcium Acetate[3] | Sodium Chloride[4] |
| 11 | Starch | Calcium Chloride[5] | Sodium Chloride[2] |

[1]20 lbs/ton dry pickup of salt.
[2]15 lbs/ton dry pickup of salt.
[3]9 lbs/ton dry pickup of salt.
[4]8 lbs/ton dry pickup of salt.
[5]5 lbs/ton dry pickup of salt.

The coating compositions shown in Table 1 above are prepared using a low shear mixer. For Coating Compositions 2 through 11, an aqueous starch solution (in an amount to provide 15% starch solids) is added to a coating container, followed by the metal salt drying agent (calcium chloride, magnesium chloride, magnesium sulfate, sodium sulfate, sodium chloride, blend of calcium chloride:calcium acetate, blend of calcium acetate:sodium chloride, or a blend of calcium chloride:sodium chloride) as an aqueous solution, followed by any additional water. For example, Coating Composition 2 is prepared by mixing together 200 g of a starch solution (at 15% starch solids) and 25 g of a calcium chloride solution (at 20% salt solids). Next, an OBA (Leucophor BCW, a stilbene-based hexasulfonate) is added as an aqueous solution in various amounts in the range of from 0 to 16 g to provide various wet pickups of OBA in the range of from 0 to 67 wet lbs OBA/ton of paper substrate. Finally, water is added to provide a total 250 g of Coating Composition 2 (14 to 16% total solids).

Example 1

Paper substrates (base paper made on a commercial production paper machine with no surface paper sizing, HST value of 0 seconds) are coated with Coating Composition 1 (water only), Coating Composition 2 (calcium chloride, see Table 1), Coating Composition 3 (magnesium chloride, see Table 1), Coating Composition 4 (magnesium sulfate, see Table 1), Coating Composition 5 (sodium sulfate, see Table 1), or Coating Composition 6 (sodium chloride, see Table 1). OBA solution is added to each of these Coating Compositions to provide OBA pickups of 0, 17, 35, or 67 wet lbs OBA/ton of paper substrate. The ISO Brightness and CIE Whiteness for each of the treated paper substrates are also measured. The results are shown in Table 2 below:

TABLE 2

| Composition | OBA Pickup (wet lbs/ton) | Salt | ISO Brightness | CIE Whiteness |
|---|---|---|---|---|
| 1 | 0 | None | 91.39 | 128.5 |
| 1 | 17 | None | 94.21 | 145.1 |
| 1 | 35 | None | 95.03 | 148.1 |
| 1 | 67 | None | 95.22 | 148.2 |
| 2 | 0 | Calcium Chloride | 91.78 | 130.7 |
| 2 | 17 | Calcium Chloride | 94.24 | 141.5 |
| 2 | 35 | Calcium Chloride | 94.72 | 142.4 |
| 2 | 67 | Calcium Chloride | 94.62 | 140.2 |
| 3 | 0 | Magnesium Chloride | 91.64 | 130.7 |
| 3 | 17 | Magnesium Chloride | 94.11 | 142.7 |
| 3 | 35 | Magnesium Chloride | 94.91 | 144.5 |
| 3 | 67 | Magnesium Chloride | 94.73 | 141.2 |
| 4 | 0 | Magnesium Sulfate | 91.47 | 129.8 |
| 4 | 17 | Magnesium Sulfate | 94.35 | 143.6 |
| 4 | 35 | Magnesium Sulfate | 94.70 | 144.4 |
| 4 | 67 | Magnesium Sulfate | 95.16 | 144.2 |
| 5 | 0 | Sodium Sulfate | 91.56 | 130.6 |
| 5 | 17 | Sodium Sulfate | 94.49 | 145.4 |
| 5 | 35 | Sodium Sulfate | 95.47 | 147.8 |
| 5 | 67 | Sodium Sulfate | 95.79 | 148.0 |
| 6 | 0 | Sodium Chloride | 91.93 | 131.2 |
| 6 | 17 | Sodium Chloride | 94.55 | 144.3 |
| 6 | 35 | Sodium Chloride | 95.62 | 148.0 |
| 6 | 67 | Sodium Chloride | 95.67 | 147.3 |

Figure 2:
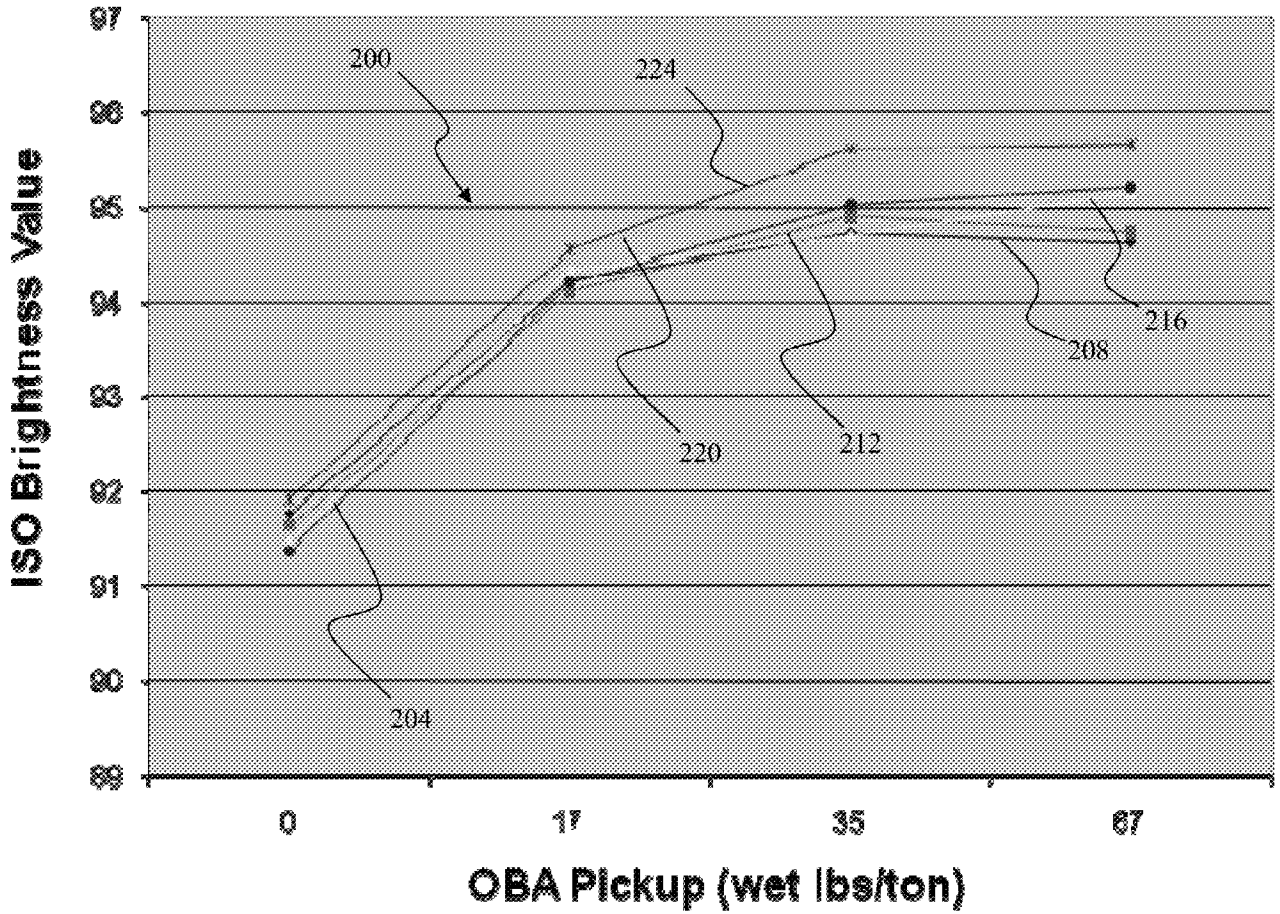
FIG. 2 shows graphical plots of ISO Brightness values versus optical brightening agent (OBA) pickup (wet lbs OBA/ton of paper substrate) of paper substrates (brightened with Leucophor BCW as the OBA) treated with no salt, calcium chloride, magnesium chloride, sodium sulfate, and sodium chloride.

FIG. 2 shows graphical plots, indicated generally as 200, of the results from Table 2 above of ISO Brightness values versus OBA pickup (wet lbs OBA/ton of paper substrate) of paper substrates treated with no salt treatment (dots), calcium chloride (diamonds), magnesium chloride (squares), magnesium sulfate (triangles), sodium sulfate (xs), and sodium chloride (asterisks). Line 204 is a plot of ISO Brightness values measured for paper substrates treated with no salt. Line 208 is a plot of ISO Brightness values measured for paper substrates treated with calcium chloride. Line 212 is a plot of ISO Brightness values measured for paper substrates treated with magnesium chloride. Line 216 is a plot of ISO Brightness values measured for paper substrates treated with magnesium sulfate. Line 220 is a plot of ISO Brightness values measured for paper substrates treated with sodium sulfate. Line 224 is a plot of ISO Brightness values measured for paper substrates treated with sodium chloride. A comparison of plots 220 and 224 (monovalent sodium salts) to plots 208, 212, and 216 (divalent calcium and magnesium salts) indicates, for equivalent OBA pickups, that paper substrates treated with monovalent metal drying salts such as sodium sulfate and sodium chloride may have higher ISO Brightness values compared to paper substrates treated with divalent metal drying salts such as calcium chloride, magnesium chloride, and magnesium sulfate.

Figure 3:
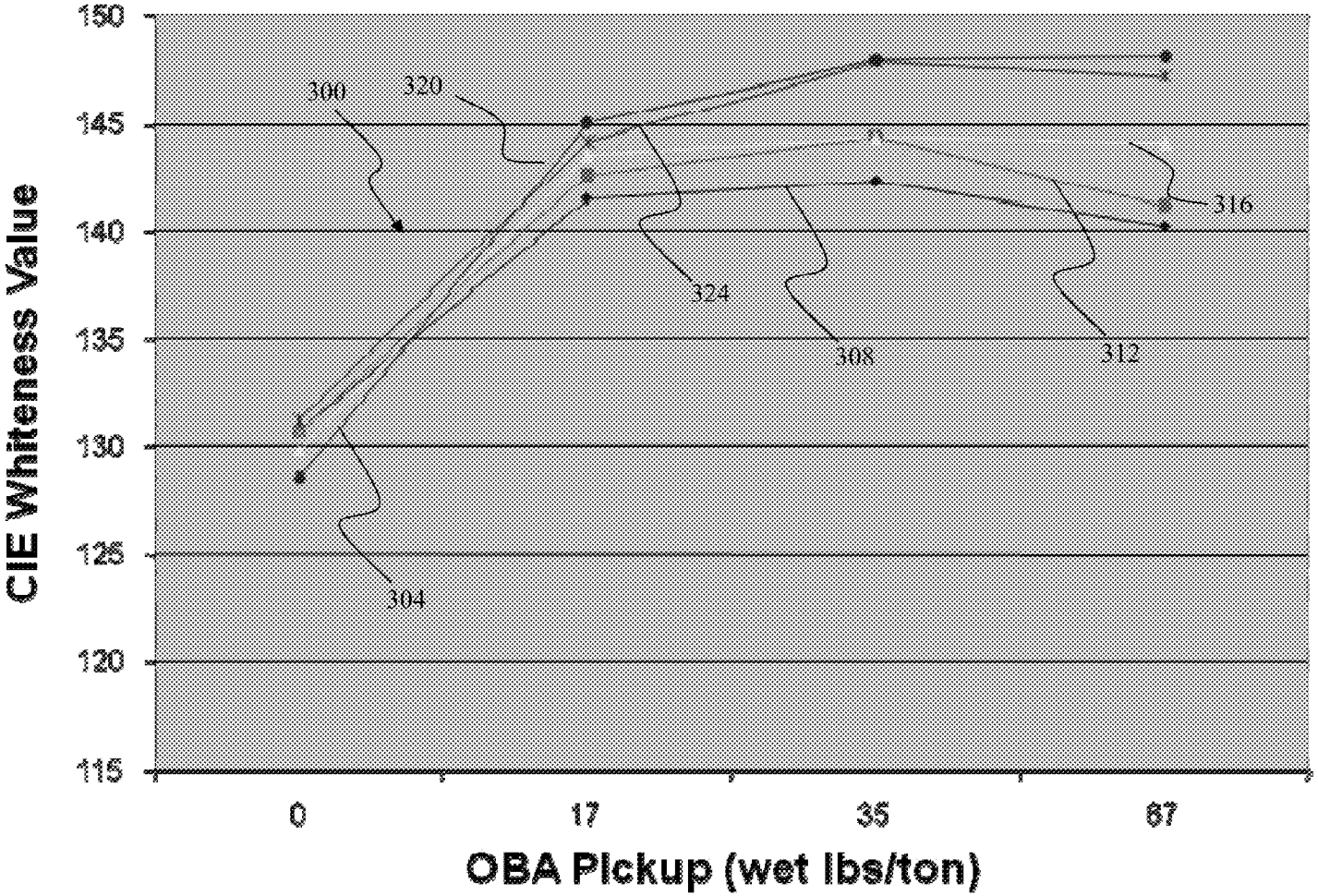
FIG. 3 shows graphical plots of CIE Whiteness values versus optical brightening agent (OBA) pickup (wet lbs OBA/ton of paper substrate) of paper substrates (brightened with Leucophor BCW as the OBA) treated no salt treatment, calcium chloride, magnesium chloride, sodium sulfate, and sodium chloride.

FIG. 3 shows graphical plots, indicated generally as 200, of the results from Table 2 above of CIE Whiteness values versus OBA pickup (wet lbs OBA/ton of paper substrate) of paper substrates treated with no salt treatment (dots), calcium chloride (diamonds), magnesium chloride (squares), magnesium sulfate (triangles), sodium sulfate (xs), and sodium chloride (asterisks). Line 304 is a plot of CIE Whiteness values measured for paper substrates treated with no salt. Line 308 is a plot of CIE Whiteness values measured for paper substrates treated with calcium chloride. Line 312 is a plot of CIE Whiteness values measured for paper substrates treated with magnesium chloride. Line 316 is a plot of CIE Whiteness values measured for paper substrates treated with magnesium sulfate. Line 320 is a plot of CIE Whiteness values measured for paper substrates treated with sodium sulfate. Line 324 is a plot of CIE Whiteness values measured for paper substrates treated with sodium chloride. A comparison of plots 320 and 324 (monovalent sodium salts) to plots 308, 312, and 316 (divalent calcium and magnesium salts) indicates, for equivalent OBA pickups, that paper substrates treated with monovalent metal drying salts such as sodium sulfate and sodium chloride may have higher CIE Whiteness values compared to paper substrates treated with divalent metal drying salts such as calcium chloride, magnesium chloride, and magnesium sulfate.

Example 2

Paper substrates (same as Example 1) are coated with Coating Composition 7 (starch only), Coating Composition 8 (calcium chloride, see Table 1), Coating Composition 9 (9:8 weight ratio of calcium chloride:calcium acetate salt blend, see Table 1), Coating Composition 10 (8:9 weight ratio of calcium acetate:sodium chloride salt blend, see Table 1), or Coating Composition 11 (1:3 weight ratio of calcium chloride: sodium chloride salt blend, see Table 1). OBA solution is added to each of these Coating Compositions to provide OBA pickups of 0, 10.7, 21.5, 33.2, 42.9, or 53.6 wet lbs OBA/ton of paper substrate. The ISO Brightness and CIE Whiteness for each of the treated paper substrates are also measured, as well as the untreated paper substrate. The results are shown in Table 3 below:

TABLE 3

| Composition | OBA Pickup (wet lbs/ton) | Components | ISO Brightness | CIE Whiteness |
|---|---|---|---|---|
| 1 | 0 | Water Only | 92.2 | 124.5 |
| 7 | 0 | Starch Only | 90.87 | 127.0 |
| 7 | 10.7 | Starch Only | 92.79 | 138.2 |
| 7 | 21.5 | Starch Only | 94.31 | 145.0 |
| 7 | 32.2 | Starch Only | 94.91 | 147.6 |
| 7 | 42.9 | Starch Only | 95.47 | 149.6 |
| 7 | 53.6 | Starch Only | 95.73 | 149.8 |
| 8 | 0 | Calcium Chloride | 91.28 | 128.0 |
| 8 | 10.7 | Calcium Chloride | 93.53 | 139.8 |
| 8 | 21.5 | Calcium Chloride | 94.52 | 142.9 |
| 8 | 32.2 | Calcium Chloride | 94.86 | 144.9 |

TABLE 3-continued

| Composition | OBA Pickup (wet lbs/ton) | Components | ISO Brightness | CIE Whiteness |
|---|---|---|---|---|
| 8 | 42.9 | Calcium Chloride | 95.26 | 144.5 |
| 8 | 53.6 | Calcium Chloride | 95.59 | 145.1 |
| 9 | 0 | 9:8 Ca Salt Blend | 91.02 | 127.5 |
| 9 | 10.7 | 9:8 Ca Salt Blend | 93.64 | 139.9 |
| 9 | 21.5 | 9:8 Ca Salt Blend | 94.54 | 142.9 |
| 9 | 32.2 | 9:8 Ca Salt Blend | 94.83 | 144.0 |
| 9 | 42.9 | 9:8 Ca Salt Blend | 95.08 | 144.7 |
| 9 | 53.6 | 9:8 Ca Salt Blend | 95.29 | 144.8 |
| 10 | 0 | 8:9 Ca:Na Salt Blend | 91.23 | 128.1 |
| 10 | 10.7 | 8:9 Ca:Na Salt Blend | 93.57 | 141.3 |
| 10 | 21.5 | 8:9 Ca:Na Salt Blend | 95.11 | 144.7 |
| 10 | 32.2 | 8:9 Ca:Na Salt Blend | 95.10 | 146.5 |
| 10 | 42.9 | 8:9 Ca:Na Salt Blend | 95.61 | 148.0 |
| 10 | 53.6 | 8:9 Ca:Na Salt Blend | 96.16 | 148.6 |
| 11 | 0 | 1:3 Ca:Na Salt Blend | 91.84 | 130.6 |
| 11 | 10.7 | 1:3 Ca:Na Salt Blend | 94.48 | 143.9 |
| 11 | 21.5 | 1:3 Ca:Na Salt Blend | 95.17 | 146.0 |
| 11 | 32.2 | 1:3 Ca:Na Salt Blend | 95.85 | 148.8 |
| 11 | 42.9 | 1:3 Ca:Na Salt Blend | 96.21 | 149.4 |
| 11 | 53.6 | 1:3 Ca:Na Salt Blend | 96.21 | 149.6 |

Figure 4:
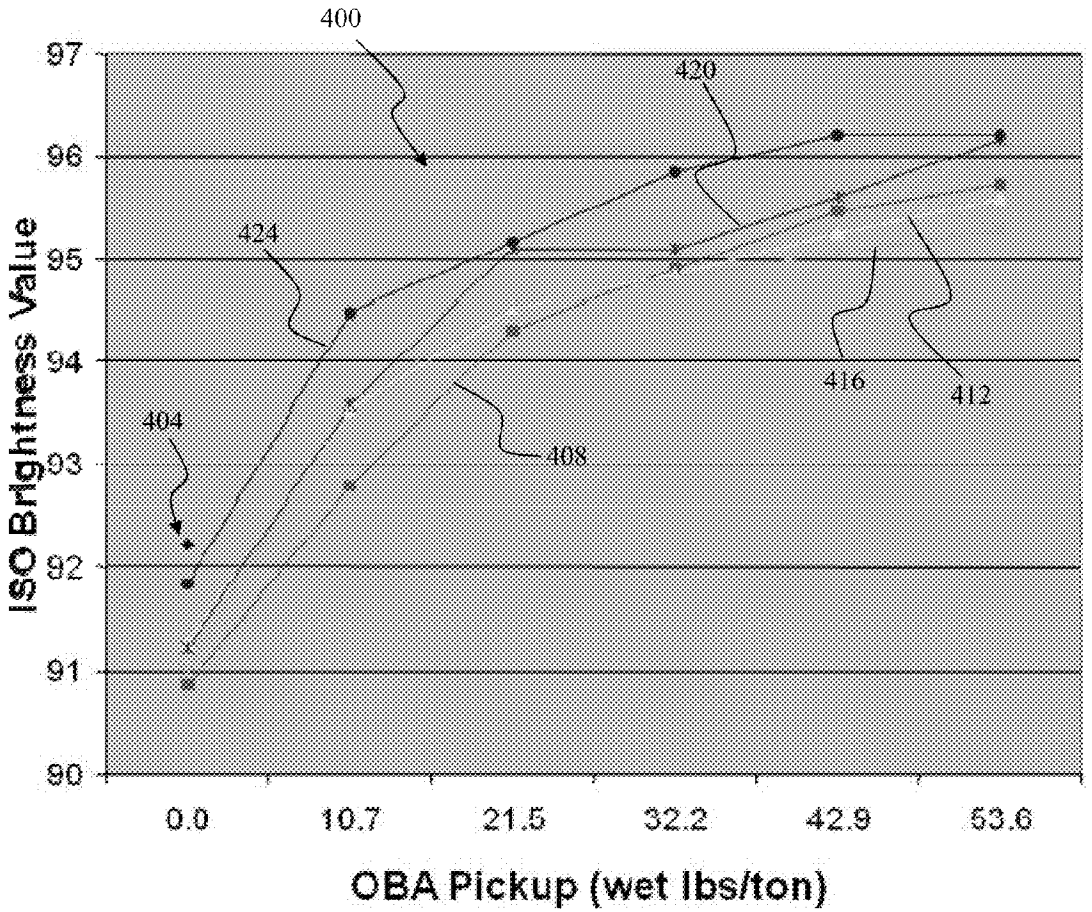
FIG. 4 shows graphical plots of ISO Brightness values versus optical brightening agent (OBA) pickup (wet lbs OBA/ton of paper substrate) of paper substrates (brightened with Leucophor BCW as the OBA) treated without salt treatment, treatment with starch only, calcium chloride, a blend of calcium chloride:calcium acetate, a blend of calcium acetate: sodium chloride, and a blend of calcium chloride:sodium chloride.

FIG. 4 shows graphical plots, indicated generally as 400, of the results from Table 3 above of ISO Brightness values versus OBA pickup (wet lbs OBA/ton of paper substrate) of an untreated paper substrate (diamond, indicated by arrow 404), as well as paper substrates treated with starch only (squares), calcium chloride (triangles), 9:8 weight ratio of calcium chloride:calcium acetate salt blend (xs), 8:9 weight ratio of calcium acetate:sodium chloride salt blend (asterisks), and 1:3 weight ratio of calcium chloride: sodium chloride salt blend (dots). Line 408 is a plot of ISO Brightness values measured for paper substrates treated with starch only. Line 412 is a plot of ISO Brightness values measured for paper substrates treated with calcium chloride. Line 416 is a plot of ISO Brightness values measured for paper substrates treated with the 9:8 weight ratio of calcium chloride:calcium acetate salt blend. Line 420 is a plot of ISO Brightness values measured for paper substrates treated with the 8:9 weight ratio of calcium acetate:sodium chloride salt blend. Line 424 is a plot of ISO Brightness values measured for paper substrates treated with the 1:3 weight ratio of calcium chloride: sodium chloride salt blend. A comparison of plots 420 and 424 (blend of monovalent sodium salts and divalent calcium salts) to plots 408, 412, and 416 (divalent calcium salt or blend of divalent calcium and magnesium salts) indicates, for equivalent OBA pickups, that paper substrates treated with blends of monovalent and divalent metal drying salts blends, such as the 8:9 calcium acetate:sodium chloride salt blend or the 1:3 calcium chloride: sodium chloride salt blend, may have higher ISO Brightness values compared to paper substrates treated only with divalent metal drying salts, such as calcium chloride or the 9:8 calcium chloride:calcium acetate salt blend.

Figure 5:
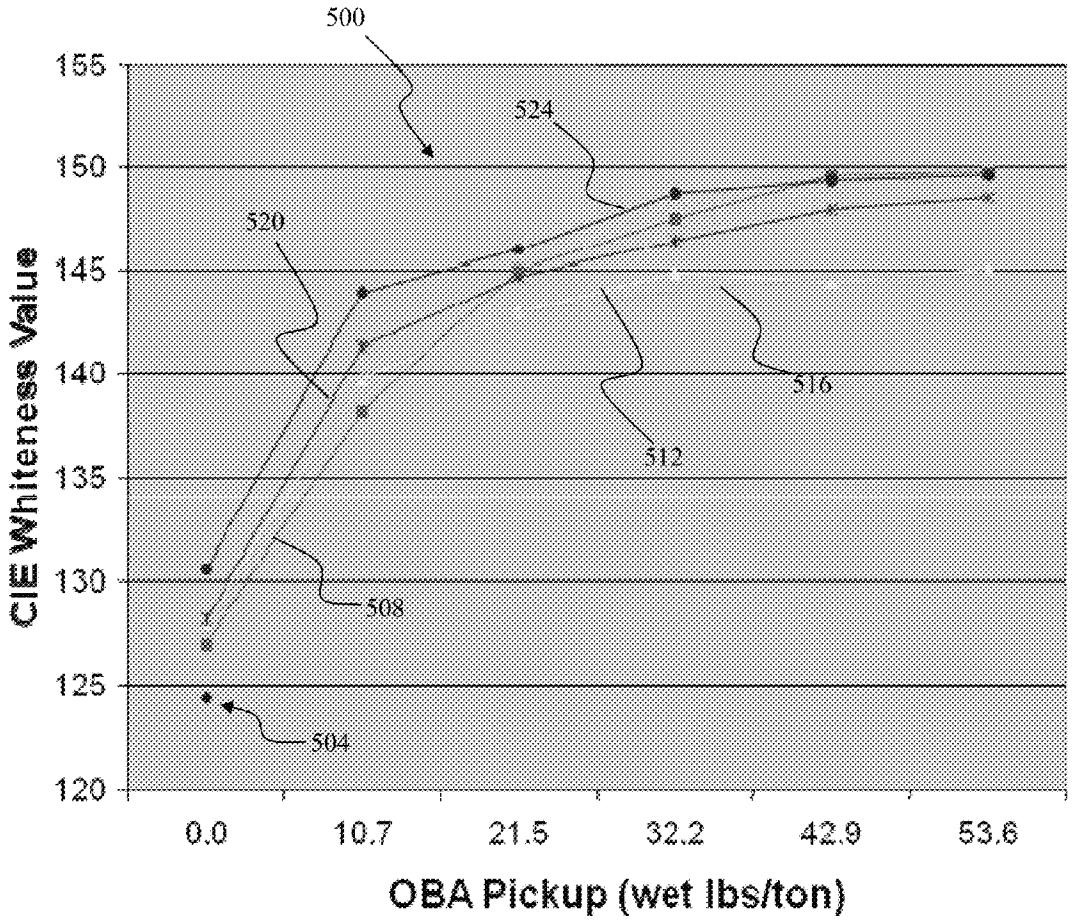
FIG. 5 shows graphical plots of CIE Whiteness values versus optical brightening agent (OBA) pickup (wet lbs OBA/ton of paper substrate) of paper substrates (brightened with Leucophor BCW as the OBA) treated without salt treatment, treatment with starch only, calcium chloride, a blend of calcium chloride:calcium acetate, a blend of calcium acetate: sodium chloride, and a blend of calcium chloride:sodium chloride.

FIG. 5 shows graphical plots, indicated generally as 500, of the results from Table 3 above of CIE Whiteness values versus OBA pickup (wet lbs OBA/ton of paper substrate) of an untreated paper substrate (diamond, indicated by arrow 504), as well as paper substrates treated with starch only (squares), calcium chloride (triangles), a 9:8 weight ratio of calcium chloride:calcium acetate salt blend (xs), 8:9 weight ratio of calcium acetate:sodium chloride salt blend (asterisks), and a 1:3 weight ratio of calcium chloride: sodium chloride salt blend (dots). Line 508 is a plot of CIE Whiteness values measured for paper substrates treated with starch only. Line 512 is a plot of CIE Whiteness values measured for paper substrates treated with calcium chloride. Line 516 is a plot of CIE Whiteness values measured for paper substrates treated with the 9:8 calcium chloride:calcium acetate salt blend. Line 520 is a plot of CIE Whiteness values measured for paper substrates treated with the 8:9 calcium acetate:sodium chloride salt blend. Line 524 is a plot of CIE Whiteness values measured for paper substrates treated with the 1:3 calcium chloride: sodium chloride salt blend. A comparison of plots 520 and 524 (blend of monovalent sodium salts and divalent calcium salts) to plots 508, 512, and 516 (divalent calcium salt or blend of divalent calcium and magnesium salts) indicates, for equivalent OBA pickups, that paper substrates treated with blends of monovalent and divalent metal drying salts, such as the 8:9 calcium acetate:sodium chloride salt blend or the 1:3 calcium chloride: sodium chloride salt blend, may have higher CIE Whiteness values compared to paper substrates treated only with divalent metal drying salts, such as calcium chloride or the 9:8 calcium chloride:calcium acetate salt blend.

All documents, patents, journal articles and other materials cited in the present application are hereby incorporated by reference.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart therefrom.

What is claimed is:

1. An article comprising:

a paper substrate having a first surface and a second surface;

an internal paper sizing agent present in an amount sufficient to impart to the paper substrate an HST value of from about 50 to about 250 seconds;

one or more optical brightening agents present in an amount below a "green over" effect excess but sufficient to impart to at least one of the first and second surfaces an ISO Brightness value of at least about 92; and a metal salt drying agent comprising a mixture of one or more multivalent metal drying salts and one or more monovalent metal drying salts and present on the at least one surface, wherein the metal salt drying agent is in an amount and has a molar ratio of multivalent cations to monovalent cations such that the at least one surface has a percent ink transferred ("IT %") value equal to or less than about 65% and a black print density value of at least about 1.45, and wherein the molar ratio of multivalent cations to monovalent cations is in the range from about 3:1 to about 1:18.

2. The article of claim 1, wherein the molar ratio of multivalent cations to monovalent cations is in the range from about 1.5:1 to about 1:12.

3. The article of claim 2, wherein the metal salt drying agent is present on both the first and second surfaces.

4. The article of claim 3, wherein the metal salt drying agent is present in an amount sufficient to provide coverage on each of the first and second surfaces of from about 0.2 to about 1.2 gsm of the metal salt drying agent.

5. The article of claim 3, wherein the metal salt drying agent is present in an amount sufficient to provide coverage on each of the first and second surfaces of from about 0.5 to about 1 gsm of the metal salt drying agent.

6. The article of claim 3, wherein the monovalent salts comprise a sodium salt, a potassium salt, or a lithium salt.

7. The article of claim 6, wherein the monovalent salts comprise a sodium salt.

8. The article of claim 7, wherein the sodium salt comprises sodium chloride.

9. The article of claim 8, wherein the multivalent salts comprise a calcium salt or a magnesium salt.

10. The article of claim 9, wherein the multivalent salts comprise a calcium salt.

11. The article of claim 10, wherein the calcium salt comprises calcium chloride.

12. The article of claim 11, wherein the metal salt drying agent has a weight ratio of calcium chloride to sodium chloride in the range of from about 1:1 to about 1:3.

13. The article of claim 1, wherein the metal salt drying agent is present on the at least one of the first and second surfaces in an amount sufficient to provide an IT % value equal to or less than about 50%.

14. The article of claim 13, wherein the metal salt drying agent is present on the at least one of the first and second surfaces in an amount sufficient to provide a IT % value equal to or less than about 40%.

15. The article of claim 1, wherein the metal salt drying agent is present on the at least one of the first and second surfaces to provide a black print density value of at least about 1.50.

16. The article of claim 15, wherein the metal salt drying agent is present on the at least one of the first and second surfaces to provide a black print density value of at least about 1.60.

17. The article of claim 1, wherein the metal salt drying agent present on the at least one of the first and second surfaces to provide an edge acuity (EA) value of less than about 15.

18. The article of claim 17, wherein the metal salt drying agent is present on the at least one of the first and second surfaces to provide an edge acuity (EA) value of less than about 10.

19. The article of claim 1, wherein the internal paper sizing agent is present in an amount sufficient to impart to the paper substrate an HST value of from about 70 to about 160 seconds.

20. The article of claim 1, wherein the one or more optical brightening agents are present in an amount sufficient to impart an ISO Brightness value of at least about 94.

21. The article of claim 20, wherein the one or more optical brightening agents are present in an amount sufficient to impart an ISO Brightness value of at least about 96.

22. The article of claim 1, wherein the one or more optical brightening agents comprise one or more of 4,4'-bis-(triazinylamino)-stilbene-2,2'-disulfonic acids, 4,4'-bis-(triazol-2-yl)stilbene-2,2'-disulfonic acids, 4,4'-dibenzofuranyl-biphenyls, 4,4'-(diphenyl)-stilbenes, 4,4'-distyryl-biphenyls, 4-phenyl-4'-benzoxazolyl-stilbenes, stilbenzyl-naphthotriazoles, 4-styryl-stilbenes, bis-(benzoxazol-2-yl) derivatives, bis-(benzimidazol-2-yl) derivatives, coumarins, pyrazolines, naphthalimides, triazinyl-pyrenes, 2-styryl-benzoxazole or -naphthoxazoles, or benzimidazole-benzofurans or oxanilides.

23. The article of claim 1, wherein the one or more optical brightening agents comprise one or more stilbene-based sulfonates.

24. The article of claim 23, wherein these one or more stilbene-based sulfonates comprise derivatives of 4,4'-diaminostilbene-2,2'-disulphonic acid, 4,4-bis(triazine-2-ylamino) stilbene-2,2"-disulphonic acid, disodium salts of distyrlbiphenyl disulfonic acid, or disodium salts of 4,4'-di-triazinylamino-2,2'-di-sulfostilbene.

25. The article of claim 1, wherein the one or more optical brightening agents are present on each of the first and second surfaces in an amount of from about 0.5 to about 2 wt % per ton of paper substrate.

26. The article of claim 25, wherein the one or more optical brightening agents are present on each of the first and second surfaces in an amount of from about 1 to about 2 wt % per ton of paper substrate.

27. The article of claim 1, wherein the one or more optical brightening agents are present in an amount sufficient to impart a CIE Whiteness value of at least about 135.

28. The article of claim 27, wherein the one or more optical brightening agents are present in an amount sufficient to impart a CIE Whiteness value of at least about 145.

* * * * *